US011866671B2

(12) United States Patent
Kraus et al.

(10) Patent No.: US 11,866,671 B2
(45) Date of Patent: Jan. 9, 2024

(54) BASE OIL OR LUBRICANT ADDITIVE

(71) Applicant: Iowa State University Research Foundation, Inc., Ames, IA (US)

(72) Inventors: George A. Kraus, Ames, IA (US); Kyle Podolak, Ames, IA (US); Derek Lee White, Lakewood, CO (US); Sriram Sundararajan, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 0 days.

(21) Appl. No.: 18/058,635

(22) Filed: Nov. 23, 2022

(65) Prior Publication Data

US 2023/0167375 A1 Jun. 1, 2023

Related U.S. Application Data

(62) Division of application No. 17/380,766, filed on Jul. 20, 2021, now Pat. No. 11,542,454.

(60) Provisional application No. 63/059,623, filed on Jul. 31, 2020.

(51) Int. Cl.

| | |
|---|---|
| ***C10M 129/70*** | (2006.01) |
| ***C10M 169/04*** | (2006.01) |
| *C10N 30/06* | (2006.01) |

(52) U.S. Cl.

CPC ..... *C10M 129/70* (2013.01); *C10M 169/04* (2013.01); *C10M 2203/003* (2013.01); *C10M 2207/281* (2013.01); *C10M 2207/284* (2013.01); *C10N 2030/06* (2013.01)

(58) Field of Classification Search

CPC ..... C10M 129/70; C10M 169/04; C10M 2203/003; C10M 2207/281; C10M 2207/284; C10N 2030/06

USPC ..... 508/305

See application file for complete search history.

(56) References Cited

U.S. PATENT DOCUMENTS 2,696,428 A * 12/1954 Stevens ..... C10M 1/08 508/307
2011/0118159 A1 5/2011 Ahlers et al.
2022/0033729 A1 2/2022 Kraus et al.

FOREIGN PATENT DOCUMENTS

WO WO-2010033447 A2 * 3/2010 ..... C10M 129/20

OTHER PUBLICATIONS

"U.S. Appl. No. 17/380,766, Non Final Office Action dated Aug. 5, 2022", 7 pgs.
"U.S. Appl. No. 17/380,766, Notice of Allowance dated Sep. 15, 2022", 8 pgs.
"U.S. Appl. No. 17/380,766, Response filed Mar. 28, 2022 to Restriction Requirement dated Mar. 3, 2022", 9 pgs.
"U.S. Appl. No. 17/380,766, Response filed Aug. 15, 2022 to Non Final Office Action dated Aug. 5, 2022", 13 pgs.
"U.S. Appl. No. 17/380,766, Restriction Requirement dated Mar. 3, 2022", 6 pgs.

(Continued)

*Primary Examiner* — Prem C Singh
*Assistant Examiner* — Francis C Campanell
(74) *Attorney, Agent, or Firm* — Schwegman Lundberg & Woessner, P.A.

(57) ABSTRACT

The present invention is toward a base oil or lubricant additives, methods of using the same, lubricant compositions including the same, and methods of forming the lubricant compositions. A base oil or lubricant additive has Structure I or Structure II as described herein.

20 Claims, 15 Drawing Sheets
(8 of 15 Drawing Sheet(s) Filed in Color)

(56) References Cited

OTHER PUBLICATIONS

"Product Data Sheet: EDGE 5W-20", Castro Limited [online]. Retrieved from the Internet: <URL: https://msdspds.castrol.com/bpglis/FusionPDS.nsf/Files/151C360D99338EDC8025863F00686257/$File/bpxe-bmj6k7.pdf>, (2020), 2 pgs.
"Product Data Sheet: GTX 5W-20", Castrol Limited [online] Retrieved from the Internet: <URL: https://msdspds.castrol.com/bpglis/FusionPDS.nsf/Files/2811CF6C9F4AF94880257EC60063ED84/$File/BPXE-A2ZRHH.pdf>, (2015), 2 pgs.
"Technical Data Sheet: Hydroisomerized Base Stocks NEXBASE(r) 3043", Neste N.V. [online] Retrieved from the Internet: <URL: https://www.neste.com/sites/default/files/attachments/tds_nexbase_3043.pdf>, (2022), 2 pgs.
Cameron, A., et al., "Studies in Interaction of Additive and Base Stock", A S L E Transactions, 19(3), (1976), 195-200.
Ding, Z. B., et al., "A topological model for predicting adsorption energies of polycyclic aromatic hydrocarbons on late-transition metal surfaces", React Chem Eng, 4(2), (2019), 410-417.
Evans, K. O., et al., "Quartz crystal microbalance investigation of the structure of adsorbed soybean oil and methyl oleate onto steel surface", Thin Solid Films, 519(2), (2010), 900-905.
Hsu, S. M,, et al., "Boundary lubricating flims: formation and lubrication mechanism", Tribology International, 38(3), (2005), 305-312.
Hsu, S. M,, et al., "Molecular basis of lubrication", Tribology International, 37(7), (2004), 553-559.
Ito, K., et al., "Formation Mechanism of a Low Friction ZDDP Tribofilm on Iron Oxide", Tribology Transactions, 50(2), (2007), 211-216.
Ito, K., et al., "Low-friction tribofilm formed by the reaction of ZDDP on iron oxide", Tribology International, 39(12), (2006), 1538-1544.
Jenkins, S. J., et al., "Aromatic adsorption on metals via first-principles density functional theory", Proceedings sof the Royal Society A: Mathematical, Physical and Engineering Sciences, 465(2110), (2009), 2949-2976.
Morin, C., et al., "Trends in the Chemisorption of Aromatic Molecules on a pt(111) Surface: Benzene, Naphthalene, and Anthracene from First Principles Calculations", The Joournal of Physical Chemistry B, 108(32), (2004), 12084-12091.
Nehme, G., et al., "Effect of contact load and lubricant volume on the properties of tribofilms formed under boundary lubrication in a fully formulated oil under extreme load conditions", Wear, 68(9-10), (2010), 1129-1147 (21 pgs.).
Nicholls, M. A., et al., "Review of the lubrication of metallic surfaces by zinc dialkyl-dithiophosphates", Tribology International, 38(1), (2005), 15-39.
Pommier, H. P., et al., "Synthesis of long-chain coumarines and 2H-chromenes. Spectral and monolayer properties", Canadian Journal of Chemistry, vol. 57, (Jun. 1979), 1377-1383.
Rizvi, S., et al., "A comprehensive review of lubricant chemistry, technology, selection, and design", ASTM International, Baltimore, MD, (2009), 674 pgs.
Rudnick, Leslie R., "Synthetics, Mineral Oils, and Bio-Based Lubricants—Chemistry and Technology", Second Edition, CRC Press, Taylor & Francis Group, (2013), 1,018 pages.
Spikes, H., et al., "Low- and zero-sulphated ash, phosphorus and sulphur anti-wear additivs for engine oils", Lubrication Science, 20(2), (2008), 103-136.
Sturms, R., et al., "Lubricant Properties of ?-1 Hydroxy Branched Fatty Acid-Containing Natural and Synthetic Lipids", Tribology Letters, 65(3), (2017), p. 99.
White, D., et al., "Tribological analysis of a novel lubricant additive: Pyrone esters", Wear, 442-443, 203115, (2020), 1-7.
White, Derek Lee, "Tribological evaluation of lubricant additives under boundary lubrication", Dissertation, Mechanical Engineering, Iowa State University, Ames, Iowa, (2020), 140 pages.
Wong, V. W., et al., "Overview of automotive engine friction and reduction trents—Effects of surface, material, and lubricant-additive technologies", Friction, 4(1), (2016), 1-28.
Zachariah, Z., et al., "Correlation Between the Adsorption and the Nanotribological Performance of Fatty Acid-Based Organic Friction Modifiers on Stainless Steel", Tribology Letter, 68: 11, (2020), 16 pgs.
Zhang, J., et al., "Boundary lubrication by adsorption film", Friction, 3(2), (2015), 115-147.

* cited by examiner

BASE OIL OR LUBRICANT ADDITIVE

CROSS-REFERENCE TO RELATED APPLICATION

This application is a divisional of U.S. patent application Ser. No. 17/380,766, filed Jul. 20, 2021, which claims the benefit of priority to U.S. Provisional Patent Application Ser. No. 63/059,623 filed Jul. 31, 2020, the disclosure of which is incorporated herein in its entirety by reference.

STATEMENT OF GOVERNMENT SUPPORT

This invention was made with Government support under EEC0813570 awarded by the National Science Foundation. The U.S. Government has certain rights in this invention.

BACKGROUND

While traditional petroleum products dominate the global lubricant markets due to their abundance, there is a steadily growing demand for synthetics and bio-based lubricants, which accounted for about twenty percent of the $146B in revenue generated in 2018. This growth is driven by government regulations compelling stricter fuel economy and emission standards as well as consumer demand for more reliable and powerful machinery. In order to meet these requirements, manufacturers are turning to the more expensive synthetics due to their superior performance. Whether the chosen oil consists of a pure synthetic base stock or the cheaper option of blending both mineral and synthetic base stocks, formulations demonstrate better thermal and oxidation stability, viscosity-temperature behavior, tribological properties, and biodegradability. Synthetic ester base stocks are one such example, which additionally boast the capability of being tailored to a specific application due to the high degree of control in the synthesis process.

SUMMARY OF THE INVENTION

A base oil or lubricant additive has the structure:

I

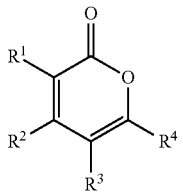

II

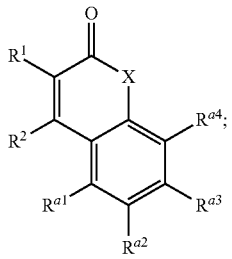

The variable X is —O— or —NH—. The variables $R^1$, $R^2$, $R^3$, $R^4$, $R^{a1}$, $R^{a2}$, $R^{a3}$, and $R^{a4}$ are independently chosen from —H, —($C_1$-$C_5$)hydrocarbyl and —$R^b$, or the structure is structure II and $R^{a1}$ and $R^{a2}$ together form a fused phenyl ring and $R^1$, $R^2$, $R^{a3}$, and $R^{a4}$ are independently chosen from —H, —($C_1$-$C_5$)hydrocarbyl and —$R^b$, or the structure is structure II and $R^{a3}$ and $R^{a4}$ together form a fused phenyl ring and $R^1$, $R^2$, $R^{a1}$, and $R^{a2}$ are independently chosen from —H, —($C_1$-$C_5$)hydrocarbyl and —$R^b$. The base oil or lubricant additive includes at least one $R^b$. At each occurrence, $R^b$ is independently chosen from —C(O)—O—$R^c$, —O—$R^c$, —S—$R^c$, and —NH—$R^c$. At each occurrence, $R^c$ is independently ($C_6$-$C_{30}$)hydrocarbyl that is interrupted by 0, 1, 2, 3, 4, or 5 groups independently chosen from —O— and —S— and that is unsubstituted or substituted with —O—($C_{6-20}$)aryl.

A lubricant composition includes the base oil or lubricant having structure I or II.

A method of forming the lubricant composition includes combining the base oil or lubricant additive having structure I or II with one or more other components to form the lubricant composition.

A method of lubricating includes applying the base oil or lubricant having structure I or II, or the lubricant composition including the base oil or lubricant additive, to an apparatus to lubricate the apparatus.

Esters are created from two building blocks: carboxylic acids and alcohols. Through proper selection, one can tune rheological and tribological behavior. Flow characteristics are determined by multiple factors that include but are not limited to the length and degree of branching of both components. In general, viscosity increases with molecular weight (overall length) whereas temperature dependent properties, viscosity index (VI) and pour point, increase with the acid chain length but decrease with greater alcohol chain lengths. Branching decreases the VI but more significantly lowers the pour point. In addition to the previously mentioned factors, the polarity of the acid impacts the friction and wear behavior, especially within the mixed and boundary lubrication regimes by controlling the effectiveness of the formed lubricant film. As the ratio between the film thickness and composite surface roughness (X ratio) decreases, the brunt of the load within a contact is carried by the asperities in conjunction with a molecularly thin lubricant layer. This softer lubricant layer acts like a cushion/barrier by extending the elastic limits of the surface and preventing adhesion between interacting asperities. However under severe conditions, plastic deformation, i.e., wear and increased friction, is inevitable. To prevent this, the film must be thick, dense, and possess both strong cohesion and adhesion. These qualities are accomplished by esters with high polarity and sufficiently long, linear chains.

This work evaluates the friction and anti-wear properties under boundary lubrication of such esters. Among other species studied, pyrone esters (PEs) of varying linear chain length were synthesized and tribologically tested. Pyrones have not been investigated as lubricants in prior literature, and therefore were chosen because of their unique chemistry. Since 2-pyrone esters possess multiple polar carbon-oxygen bonds, the molecules interact strongly with both metal oxides and one another thus providing strong substrate adhesion and intermolecular cohesion, respectively. Furthermore, linear chains allow high packing density and bolster cohesion. For these reasons, PEs have potential not only as a base oil but also as a lubricant additive.

In addition, PEs are environmentally friendly. Esters-particularly linear variants-readily hydrolyze in the presence of lipase, an enzyme produced by microorganisms, thus making them more biodegradable than hydrocarbon base stocks. Beyond this, a lubricant's renewability must also be considered in order to be considered green. Fortunately, a major reactant of PE is either coumalic acid or a coumalic salt. Coumalic acid is easily prepared from malic acid, a biorenewable generated from agricultural waste. In short, PEs were chosen due to their potential to effectively fulfill a growing demand for readily available synthetic lubricants. A brief summary of the synthesis process used for the PEs in this study is provided along with material characterization via nuclear magnetic resonance (NMR) and high-resolution mass spectroscopy (HRMS). Other properties of note were investigated such as the additives' temperature dependent viscosity, which was characterized via parallel plate rheometer, and tribological behavior, which was tested using a custom microtribometer. Each additive's performance and lubricating mechanisms are discussed.

The polarity (dipole moment of 6.2D) and polarizability of the pyrone moiety plus its potential as a phenol isostere may partially explain the antiwear properties of various base oils and lubricant additives of the present invention. The dipole moments of acyclic esters such as ethyl oleate is only 1.8D.

BRIEF DESCRIPTION OF THE FIGURES

The patent or application file contains at least one drawing executed in color. Copies of this patent or patent application publication with color drawing(s) will be provided by the Office upon request and payment of the necessary fee.

The drawings illustrate generally, by way of example, but not by way of limitation, various embodiments of the present invention.

DETAILED DESCRIPTION OF THE INVENTION

Figure 1:
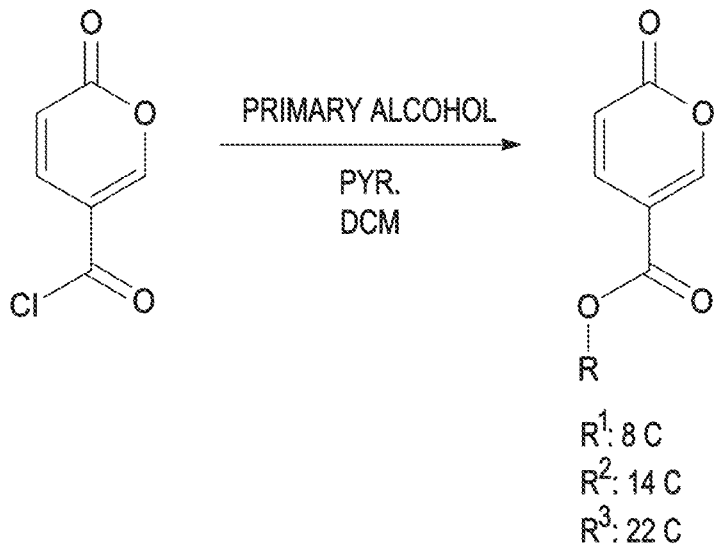
FIG. 1 illustrates a reaction pathway to and the molecular structure of pyrone esters, in accordance with various embodiments.

Reference will now be made in detail to certain embodiments of the disclosed subject matter. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" or "at least one of A or B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the invention, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99/0, or at least about 99.999% or more, or 100%. The term "substantially free of" as used herein can mean having none or having a trivial amount of, such that the amount of material present does not affect the material properties of the composition including the material, such that about 0 wt % to about 5 wt % of the composition is the material, or about 0 wt % to about 1 wt %, or about 5 wt % or less, or less than, equal to, or greater than about 4.5 wt %, 4, 3.5, 3, 2.5, 2, 1.5, 1, 0.9, 0.8, 0.7, 0.6, 0.5, 0.4, 0.3, 0.2, 0.1, 0.01, or about 0.001 wt % or less, or about 0 wt %.

The term "hydrocarbon" or "hydrocarbyl" as used herein refers to a molecule or functional group that includes carbon and hydrogen atoms. The term can also refer to a molecule or functional group that normally includes both carbon and hydrogen atoms but wherein all the hydrogen atoms are substituted with other functional groups.

As used herein, the term "hydrocarbyl" refers to a functional group derived from a straight chain, branched, or cyclic hydrocarbon, and can be alkyl, alkenyl, alkynyl, aryl, cycloalkyl, acyl, or any combination thereof. Hydrocarbyl groups can be shown as $(C_a\text{-}C_b)$hydrocarbyl, wherein a and b are integers and mean having any of a to b number of carbon atoms. For example, $(C_1\text{-}C_4)$hydrocarbyl means the hydrocarbyl group can be methyl $(C_1)$, ethyl $(C_2)$, propyl $(C_3)$, or butyl $(C_4)$, and $(C_0\text{-}C_b)$hydrocarbyl means in certain embodiments there is no hydrocarbyl group.

As used herein, the term "polymer" refers to a molecule having at least one repeating unit and can include copolymers.

Base Oil or Lubricant Additive.

Various aspects of the present invention provide a base oil or lubricant additive having the structure:

I

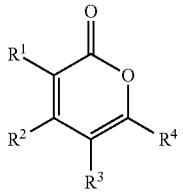

II

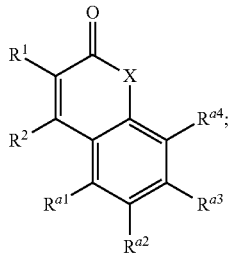

The variable X can be —O— or —NH—. The variables $R^1$, $R^2$, $R^3$, $R^4$, $R^{a1}$, $R^{a2}$, $R^{a3}$, and $R_{a4}$ can be independently chosen from —H, —$(C_1\text{-}C_5)$hydrocarbyl and —$R^b$, or the structure is structure II and $R^{a1}$ and $R^{a2}$ together form a fused phenyl ring and $R^1$, $R^2$, $R^{a3}$, and $R^4$ can be independently chosen from —H, —$(C_1\text{-}C_5)$hydrocarbyl and —$R^b$, or the structure is structure II and $R^{a3}$ and $R^{a4}$ together form a fused phenyl ring and $R^1$, $R^2$, $R^{a1}$, and $R^{a2}$ can be independently chosen from —H, —$(C_1\text{-}C_5)$hydrocarbyl and —$R^b$. The base oil or lubricant additive can include at least one $R^b$. At each occurrence, $R^b$ can be independently chosen from —C(O)—O—$R^c$, —O—$R^c$, —S—$R^c$, and —NH—$R^c$. At each occurrence, $R^c$ can be independently $(C_6\text{-}C_{30})$ hydrocarbyl that is interrupted by 0, 1, 2, 3, 4, or 5 groups independently chosen from —O— and —S— and that can be unsubstituted or substituted with —O—$(C_{6\text{-}20})$)aryl.

At least one of $R^1$, $R^2$, $R^3$, $R^4$, $R^{a1}$, $R^{a2}$, $R^{a3}$, and $R^{a4}$ can be —$R^b$. The base oil or lubricant can have the structure I, wherein at least one of $R^1$, $R^2$, $R^3$, and $R^4$ is —$R^b$. The base oil or lubricant the structure II, wherein at least one of $R^1$, $R^2$, $R^{a1}$, $R^{a2}$, $R^{a3}$, and $R^{a4}$ is —$R^b$. The base oil or lubricant can include one and not more than one —$R^b$. In some aspects, one of $R^2$, $R^3$, and $R^{a3}$ is —$R^b$. In some aspects, $R^b$ can be independently chosen from —C(O)—O—$R^c$.

The variables $R^1$, $R^2$, $R^3$, $R^4$, $R^{a1}$, $R^{a2}$, $R^{a3}$, and $R^{a4}$ can be independently chosen from —H, —$(C_1\text{-}C_5)$hydrocarbyl and —$R^b$; or from —H, —$(C_1\text{-}C_3)$hydrocarbyl and —$R^b$; or from —H, methyl, and $R^b$.

At each occurrence $R^c$ can be independently $(C_6\text{-}C_{30})$ alkyl, or $(C_8\text{-}C_{22})$alkyl, or $(C_{13}\text{-}C_{15})$alkyl. At each occurrence, $R^c$ can be independently —$((CH_2\text{—}CH_2)\text{—}O)_n$—$CH_3$, wherein n is 1 to 10 (e.g., 1, 2, 3, 4, 5, 6, 7, 8, 9, or 10).

At each occurrence, $R^c$ can be independently —$(C_6\text{-}C_{30})$ alkyl-O-phenyl. At each occurrence, $R^c$ can be independently —$(C_6\text{-}C_{30})$alkyl-O-naphthyl. At each occurrence, $R^c$ can be independently $(C_8)$alkyl, $(C_{10})$alkyl, $(C_{14})$alkyl, $(C_{15})$ alkyl, or $(C_{22})$alkyl. At each occurrence, $R^c$ can be linear or branched.

In various aspects, $R^1$, $R^2$, $R^3$, $R^4$, $R^{a1}$, $R^{a2}$, $R^{a3}$, and $R^{a4}$ are independently chosen from —H, methyl, and —$R^b$; the base oil or lubricant additive includes one $R^b$ and not more than one $R^b$; and $R^b$ is —C(O)—O—$(C_8)$alkyl, —C(O)—O—$(C_{14})$alkyl, —C(O)—O—$(C_{22})$alkyl, —C(O)—O—$(C_{10})$alkyl, —C(O)—O—$(C_{15})$alkyl, —O—$(C_{14})$alkyl, or —NH—$(C_{14})$alkyl.

In various aspects, the base oil or lubricant additive has the structure I; $R^1$, $R^2$, $R^3$, and $R^4$ are independently chosen from —H and —$R^b$; the base oil or lubricant additive includes one $R^b$ and not more than one $R^b$; and $R^b$ is —C(O)—O—$(C_8)$alkyl, —C(O)—O—$(C_{14})$alkyl, —C(O)—O—$(C_{22})$alkyl, —C(O)—O—$(C_{10})$alkyl, or —C(O)—O—$(C_{15})$alkyl.

In various aspects, the base oil or lubricant additive has the structure I; $R^1$, $R^2$, $R^3$, and $R^4$ are independently chosen from —H and —$R^b$; the base oil or lubricant additive includes one $R^b$ and not more than one $R^b$; and $R^b$ is —C(O)—O—($C_8$)alkyl, —C(O)—O—($C_{14}$)alkyl, or —C(O)—O—($C_{22}$)alkyl.
In various aspects, the base oil or lubricant additive has one of the following structures:
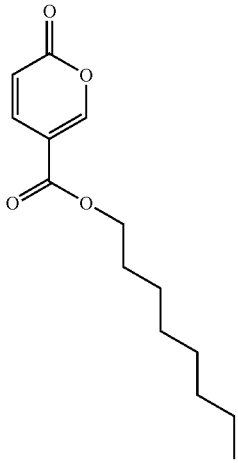
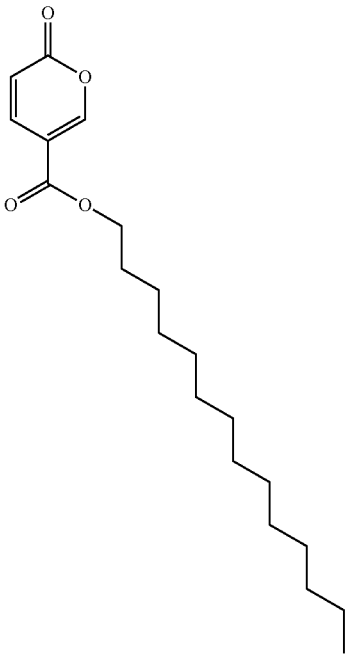
-continued
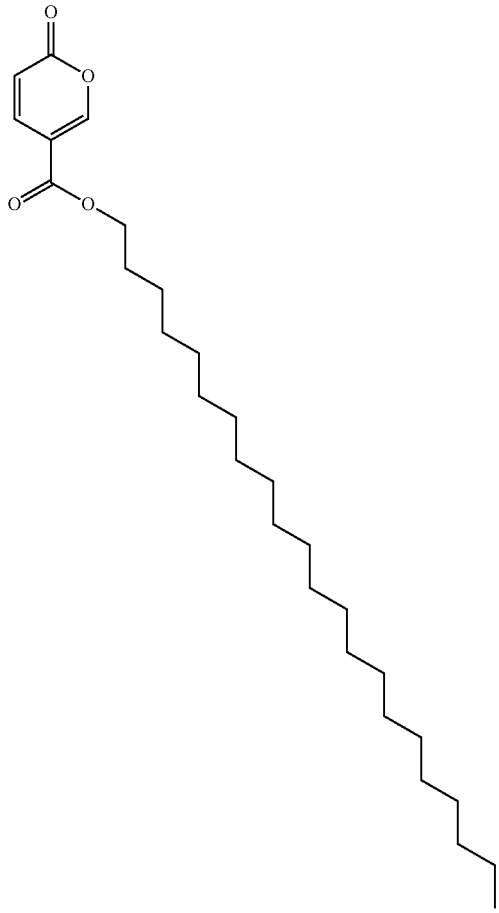
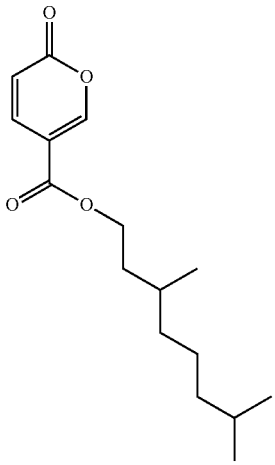

-continued
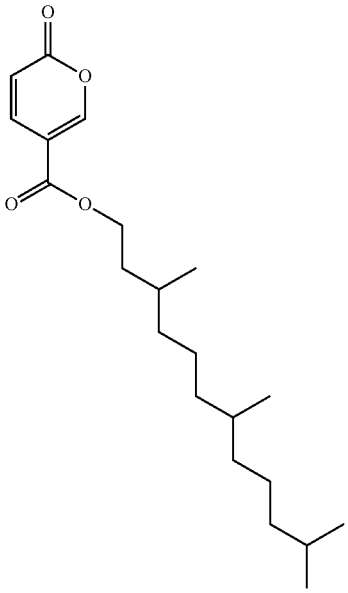
-continued
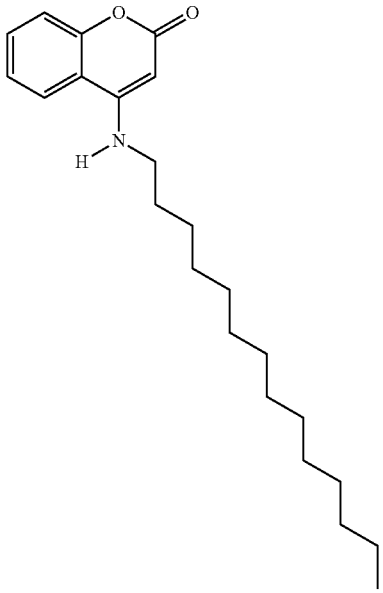
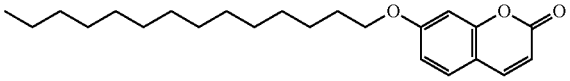
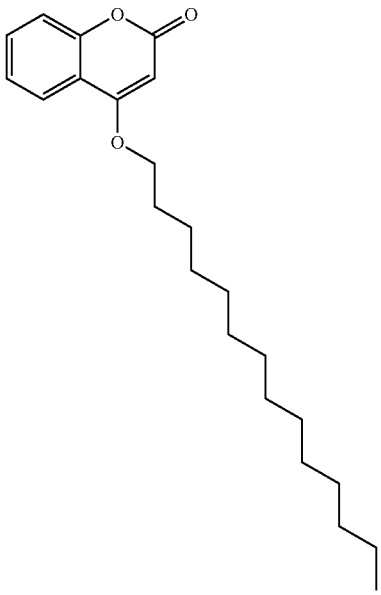
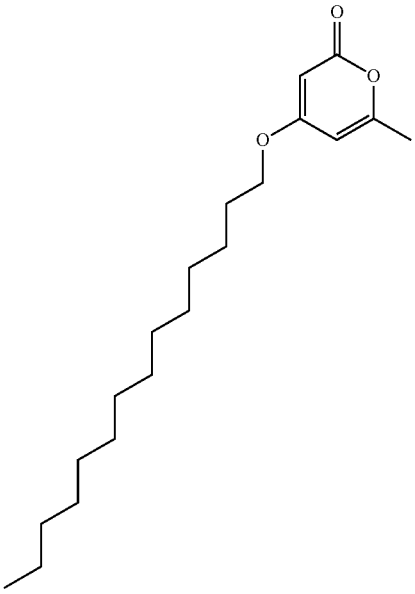
and -continued
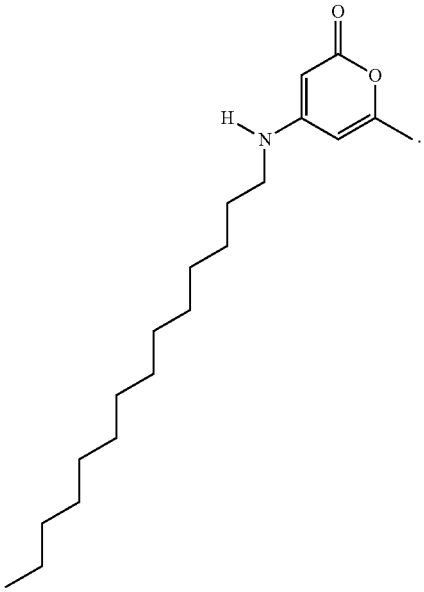
-continued
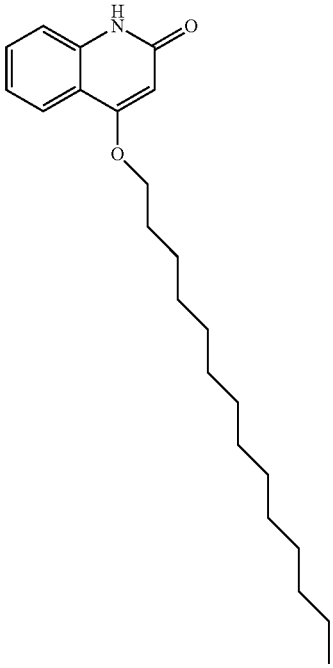
In various aspects, the base oil or lubricant additive has one of the following structures:
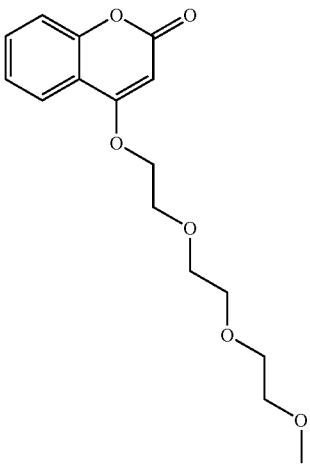
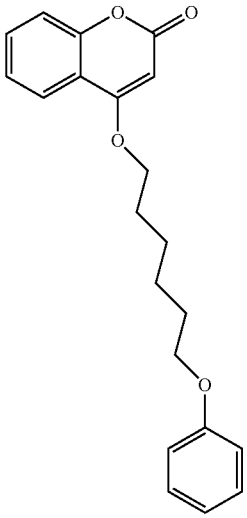
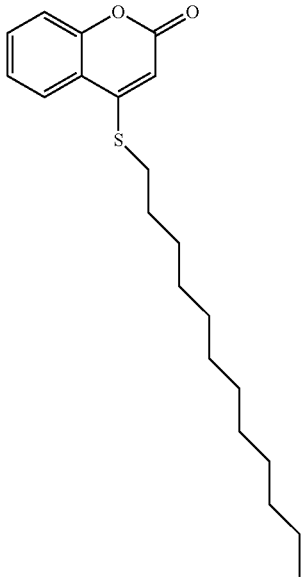

-continued

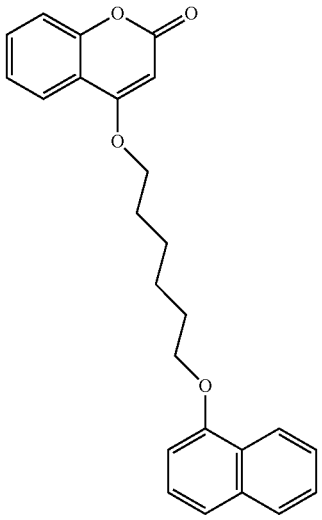

-continued

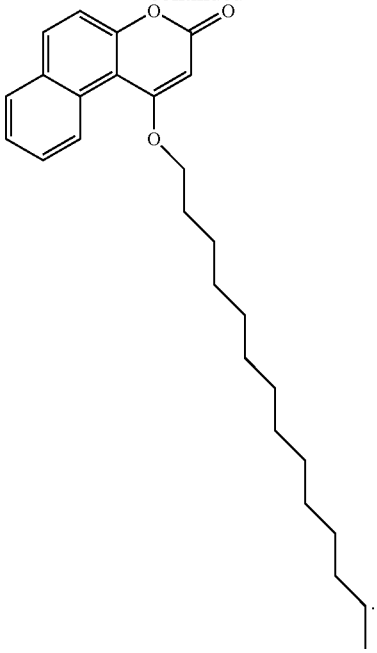

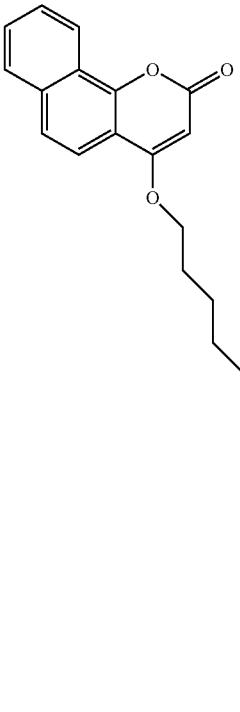

and

The base oil or lubricant additive can be ocyl coumalate. The base oil or lubricant additive can be tetradecyl coumalate. The base oil or lubricant additive can be docosyl coumalate. The base oil or lubricant additive can be 4-tetradecyloxy-6-methyl-2-pyrone. The base oil or lubricant additive can be 4-tetradecyloxy coumarin. The base oil or lubricant additive can exhibit anti-wear properties, friction-reducing properties, or a combination thereof. For example, the base oil or lubricant additive can exhibit anti-wear properties.

Lubricant Composition.

Various aspects of the present invention provide a lubricant composition that includes at least one embodiment of the base oil or lubricant additive described herein. The lubricant composition can include one of the base oils or lubricant additives described herein. The lubricant composition can include two or more of the base oils or lubricants of the present invention that have different structures.

The base oil or lubricant additive of the present invention can be any suitable proportion of the lubricant composition, such as 0.001 wt % to 100 wt % of the lubricant composition, 0.5 wt % to 100 wt % of the lubricant composition, or less than, equal to, or greater than 0.001 wt %, 0.005, 0.01, 0.05, 0.1, 0.5, 1, 2, 3, 4, 5, 10, 15, 20, 25, 30, 35, 40, 45, 50, 55, 60, 65, 70, 75, 80, 85, 90, 95, 96, 97, 98, 99, 99.9, 99.99, or 99.999 wt % or more.

In various aspects, the lubricant composition includes a embodiment of a lubricant additive of the present invention, and the lubricant composition further includes a base lubricant composition oil (e.g., a commercial base oil, a mineral oil, a synthetic oil, or a combination thereof). The lubricant additive can be any suitable proportion of the composition, such as 0.001 wt % to 50 wt % of the lubricant composition, 0.1 wt % to 20 wt %, or less than, equal to, or greater than 0.001 wt %, 0.005, 0.01, 0.05, 0.1, 0.5, 1, 2, 3, 4, 5, 10, 15, 20, 25, 30, 35, 40, 45, or 50 wt % or more. The base oil can be 50 wt % to 99.999 wt % of the lubricant composition, such as less than, equal to, or greater than 50 wt %, 55, 60, 65, 70, 75, 80, 85, 90, 95, 96, 97, 98, 99, 99.9, 99.99, or 99.999 wt % or more.

The base oil can be or include a mineral oil, such as an API Group I mineral oil, an API Group II mineral oil, an API Group III mineral oil, an API Group IV mineral oil, an API Group V mineral oil, an API paraffinic mineral oil, an API naphthenic mineral oil, an aromatic mineral oil, or a combination thereof. The mineral oil can be an API Group III mineral oil. The mineral oil can be an isoparaffinic API Group III base oil The base oil can be or include a synthetic oil, such as a polyalpha-olefin, a synthetic ester, a polyalkylene glycol, a phosphate ester, an alkylated naphthalene, a silicate ester, an ionic fluid, a multiply alkylated cyclopentane, or a combination thereof.

The lubricant composition can optionally include one or more lubricating oil additives, such as a pour point depressant, an anti-foaming agent, a viscosity index improver, an antioxidant, a detergent, a corrosion inhibitor, an anti-wear additive, an extreme pressure additive, a friction modifier, or a combination thereof.

Method of Forming the Lubricant Composition.

Various aspects of the present invention provide a method of forming an embodiment of the lubricant composition described herein. The method can include combining an embodiment of the base oil or lubricant described herein with one or more other components to form the lubricant composition. In some embodiments, the method includes adding an embodiment of the lubricant additive described herein to a base oil along with one or more other optional components to form the lubricant composition described herein.

Method of Lubricating.

Various aspects of the present invention provide a method of lubricating. The method can include applying to an apparatus an embodiment of the base oil or lubricant additive described herein, or an embodiment of the lubricant composition described herein, to lubricate the apparatus. The method can include applying the base oil or lubricant additive, or the lubricant composition, to a location in the apparatus that experiences surface-on-surface friction, such as metal-on-metal friction, metal-on-polymer friction, polymer-on-polymer friction, or a combination thereof.

EXAMPLES

Various embodiments of the present invention can be better understood by reference to the following Examples which are offered by way of illustration. The present invention is not limited to the Examples given herein.

Part I. Pyrone Esters.

Example 1. Synthesis of Pyrone Esters (PEs)

A 0.1 M solution of primary alcohol (8, 14, or 22 carbon, 1 equiv.) was made in dichloromethane, and pyridine (1.2 equiv.) was added and stirred for 10 minutes at room temperature. Coumalic acid chloride (1 equiv.) was then added and the resulting solution was allowed to stir overnight at room temperature. The reaction was quenched with $H_2O$ and extracted with EtOAc (3×100 mL). The organic layers were combined and then washed with brine, dried over $Na_2SO_4$, and concentrated in vacuo. Column chromatography with hexanes/EtOAc (8:1) gave the ester as a pale yellow solid or oil. The molecular structure and reaction pathway is detailed in FIG. 1.

The chemical composition and structure were verified via $^1H$ and $^{13}C$ NMR spectroscopy in conjunction with HRMS. Octyl Coumalate (C8 chain ester): $^1H$ NMR (400 MHz, $CDCl_3$) δ: 8.289 (dd, J=4.0, 1.08 Hz, 1H), 7.786 (dd, J=9.68, 2.6 Hz, 1H), 6.338 (dd, J=9.84, 4.0 Hz, 1H), 4.27 (t, J=6.76 Hz, 2H), 1.71 (m, 2H), 1.28 (m, 10H), 0.88 (t, J=6.48 Hz, 3H); $^{13}C$ NMR (400 MHz, $CDCl_3$) δ: 163.0, 159.5, 157.9, 115.3, 112.2, 65.8, 31.8, 29.2, 28.6, 25.9, 22.6, 14.1; HRMS (ESI) m/z calculated for $[M+1]^+[C_{14}H_2O_4]^+$: 253.1434, found 253.1434. Tetradecyl Coumalate (C14 chain ester): $^1H$ NMR (400 MHz, $CDCl_3$) δ: 8.289 (dd, J=2.56, 1.04 Hz, 1H), 7.785 (dd, J=9.8, 2.6 Hz, 1H), 6.337 (dd, J=9.8, 1.04 Hz, 1H), (t, J=6.64 Hz, 2H), 1.713 (m, 2H), 1.256 (m, 22H), 0.876 (t, J=7.04 Hz, 3H); $^{13}C$ NMR (400 MHz, $CDCl_3$) δ: 163.0, 159.9, 157.99, 141.8. 115.3, 112.2, 65.8, 31.9, 29.7, 29.6, 29.5, 29.4, 29.2, 25.9, 22.7, 14.2; HRMS (ESI) m/z calculated for $[M+1]^+[C_{20}H_{32}O_4]^+$: 337.2372, found 337.2371. Docosyl Coumalate (C22 chain ester): $^1H$ NMR (400 MHz, $CDCl_3$) δ: 8.308 (dd, J=2.56, 1.12 Hz, 1H), 7.806 (dd, J=9.8, 2.6 Hz, 1H), 6.359 (dd, J=9.8, 1.12 Hz, 1H), 4.286 (t, J=6.72 Hz, 2H), 1.731 (m, 2H), 1.576 (m, 3H), 1.267 (m, 38H), 0.893 (t, J=6.96, 3H); $^{13}C$ NMR (400 MHz, $CDCl_3$) δ: 163.0, 157.9, 141.7, 115.3, 65.8, 63.1, 32.8, 31.9, 29.7, 29.6, 29.5, 29.4, 29.3, 29.2, 28.6, 25.9, 25.8, 22.7, 14.1; HRMS (ESI) m/z calculated for $[M+1]^+[C_{28}H_{48}O_4]^+$: 449.3625, found 449.3620.

A commercially available monoester (Priolube 1976) was acquired from Croda Lubricants to compare the PEs effectiveness to a product currently on the market. The commercial oil (CO) is described by the manufacturer as a "low polarity and oxidatively stable mono-ester, suitable for use both as a base fluid and an additive". While exact chemical composition is unknown, the CO was chosen because the PEs are also mono-esters yet have high polarity. Therefore, the effect of the additives' surface affinity could be gauged. Technical data for the CO supplied by the manufacturer has been provided in Table 1.

TABLE 1

Manufacturer reported physical properties for the commercial additive. Test methods were not specified by the manufacturer.

| Property | Value |
|---|---|
| Kinematic viscosity ($mm^2/s$) | |
| 40° C. | 26 |
| 100° C. | 5.4 |
| Viscosity index | 157 |
| Pour Point | −33° C. |
| Flash Point | 260° C. |
| Density, at 20° C. (g/ml) | 0.86 |

Example 2. Rheology Characterization

Figure 2:
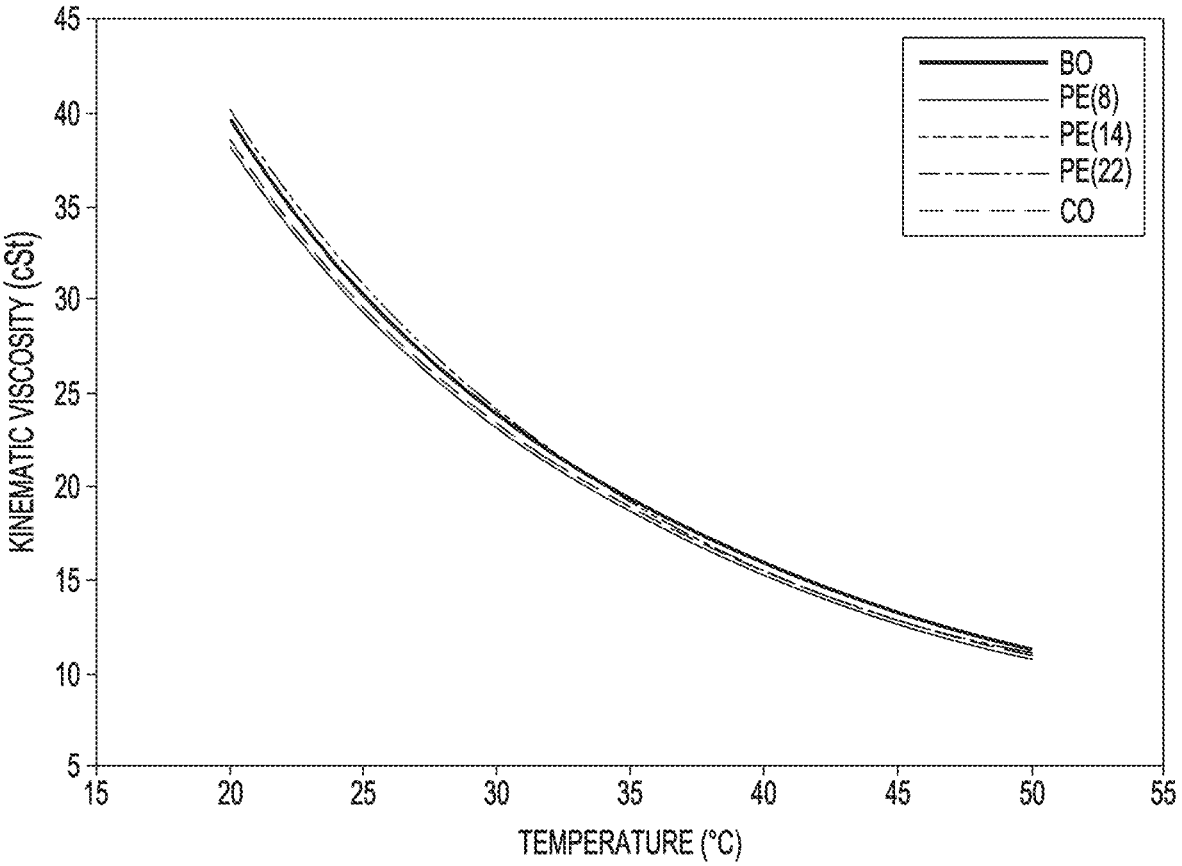
FIG. 2 illustrates kinematic viscosity of various ester blends as a function of temperature, in accordance with various embodiments.

All esters including the CO were blended at 1% by weight into a commercially available isoparaffinic API Group III base oil (NEXBASE 3043) and found to be readily soluble. The base oil technical data from the manufacturer has been provided in Table 2. Dynamic viscosity was characterized from 20-50° C. using an AR 2000 rheometer (TA Instruments) outfitted in a parallel plate (25 mm diameter) configuration at a constant shear rate of 120 $s^{-1}$ and gap distance of 500 μm. Three replicates for each treatment were performed. Kinematic viscosity was then calculated from known densities, and results demonstrated similar values between all ester blends as seen in FIG. 2. FIG. 2 illustrates kinematic viscosity of various ester blends (1% by weight) as a function of temperature. It was thus determined that each lubricant's viscosity would not factor into their respective friction or wear performance. Rather, differences in tribological behavior would be solely dependent on chemical composition.

TABLE 2

Manufacturer reported physical properties for the base oil.

| Property | Value | Test Method |
|---|---|---|
| Kinematic viscosity ($mm^2/s$) | | ASTM D-445 |
| 40° C. | 20 | |
| 100° C. | 4.3 | |
| Viscosity index | 122 | ASTM D-2270 |
| Pour Point | −18° C. | ASTM D-97 |
| Flash Point | 228° C. | ASTM D-92 |
| Density, at 15° C. (g/ml) | 0.837 | ASTM D-4052 |

Example 3. Tribological Testing

Figure 3:
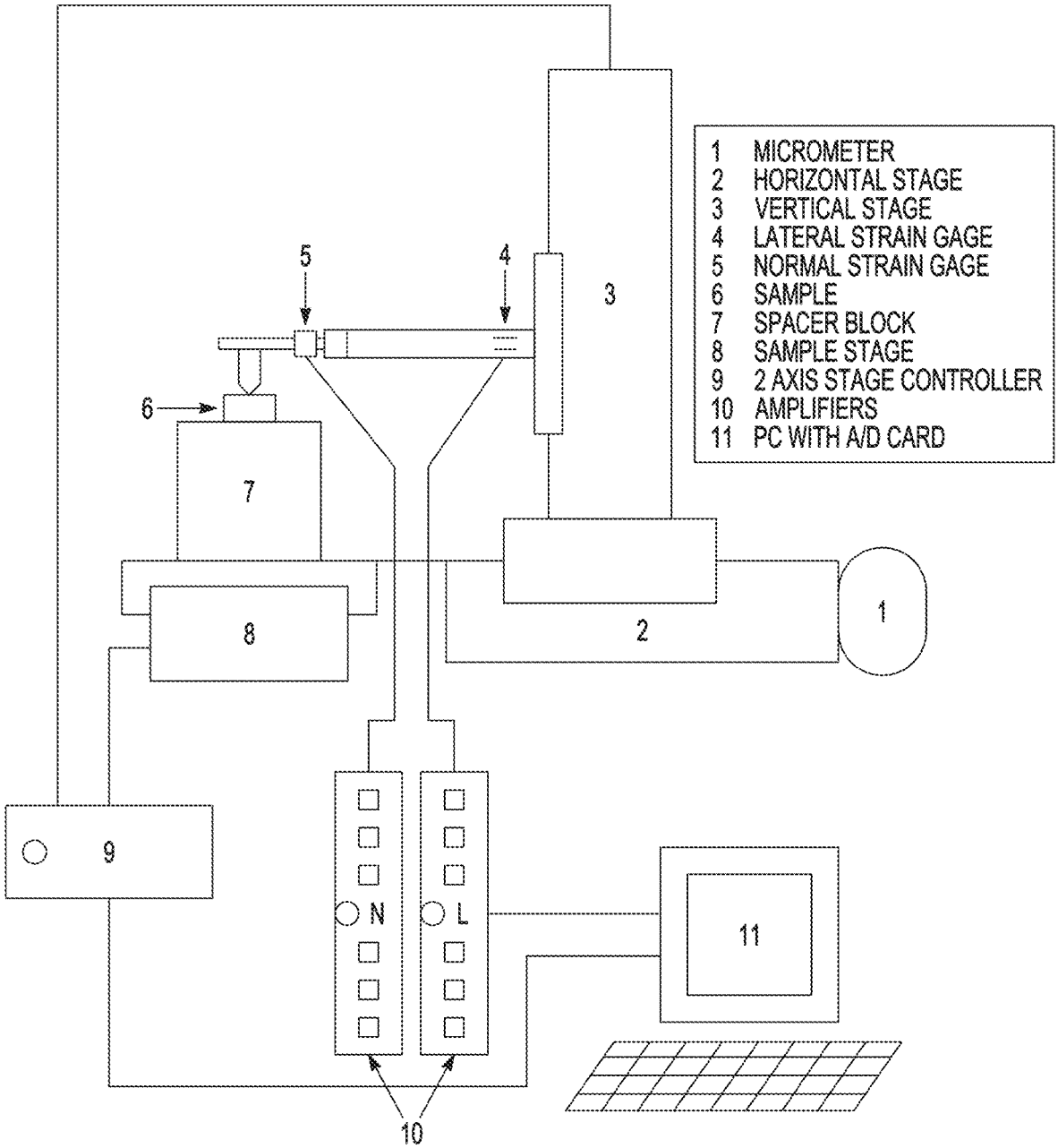
FIG. 3 illustrates a schematic of a microtribometer used in the Examples, in accordance with various embodiments.

Reciprocating tests were used to characterize both friction and wear behavior of the ester blends at 25° C. and 40° C. under boundary lubrication. As mentioned prior, each ester was blended at a concentration of 1% by weight. Neat oil served as the control. The testing device is a custom ball-on-flat microtribometer as seen in FIG. 3 and was operated in conjunction with a temperature-controlled stage. In brief, precise normal loading of a probe onto the sample substrate is performed via software controlled linear stages. The sample substrate is forced to slide against the probe and subsequent lateral or frictional forces are measured. The temperature-controlled stage consists of an aluminum block that contains an oil reservoir. The block's temperature is monitored and controlled via an adhesive thermocouple connected to a PID controller. In addition, the oil temperature is monitored with a thermistor. Prior to testing, an equal volume filled the reservoir and the oil temperature was equilibrated. The oil level sits just above the substrate surface so there is a constant supply of oil into the contact zone.

Reciprocating tests were carried out using a SiC-steel interface: a 4 mm diameter silicon carbide ball on an AISI 8620 steel substrate. The ceramic was chosen for its superior hardness relative to the substrate in order to isolate the majority of the wear to the substrate and preserve the probes geometry. In this way, a consistent contact pressure can be maintained. A constant normal load of 3.4 N (maximum Hertzian pressure of 1.5 GPa) was applied as the substrate was translated at a rate of 10 mm/s over a 8 mm stroke length for 4500 cycles. The load was chosen after initial tests with the PEs at 1.0 GPa were not sufficient to generate measureable wear scars (wear depths were on the same order as the surface roughness). The substrate was isotropically polished to a finish of 0.043 μm Ra determined from a scan area of 1.41 mm×1.88 mm using a Zygo optical profilometer. Based on EHL theory, the roughness, load, and viscosity parameters placed this study well within the boundary lubrication regime as the estimated λ ratio was much less than one.

After test completion, the substrate and probes were wiped with isopropyl alcohol before undergoing SEM and EDS analysis. In addition, the substrate wear scars were scanned using the Zygo optical profilometer. Nine to eleven unique scan areas were gathered to capture the entire length of each scar. All topographic and force data was then imported into MATLAB where the average wear depth and coefficient of friction was calculated. Three replicate tests were completed for each treatment.

Example 4. Results and Discussion

Figure 4A:
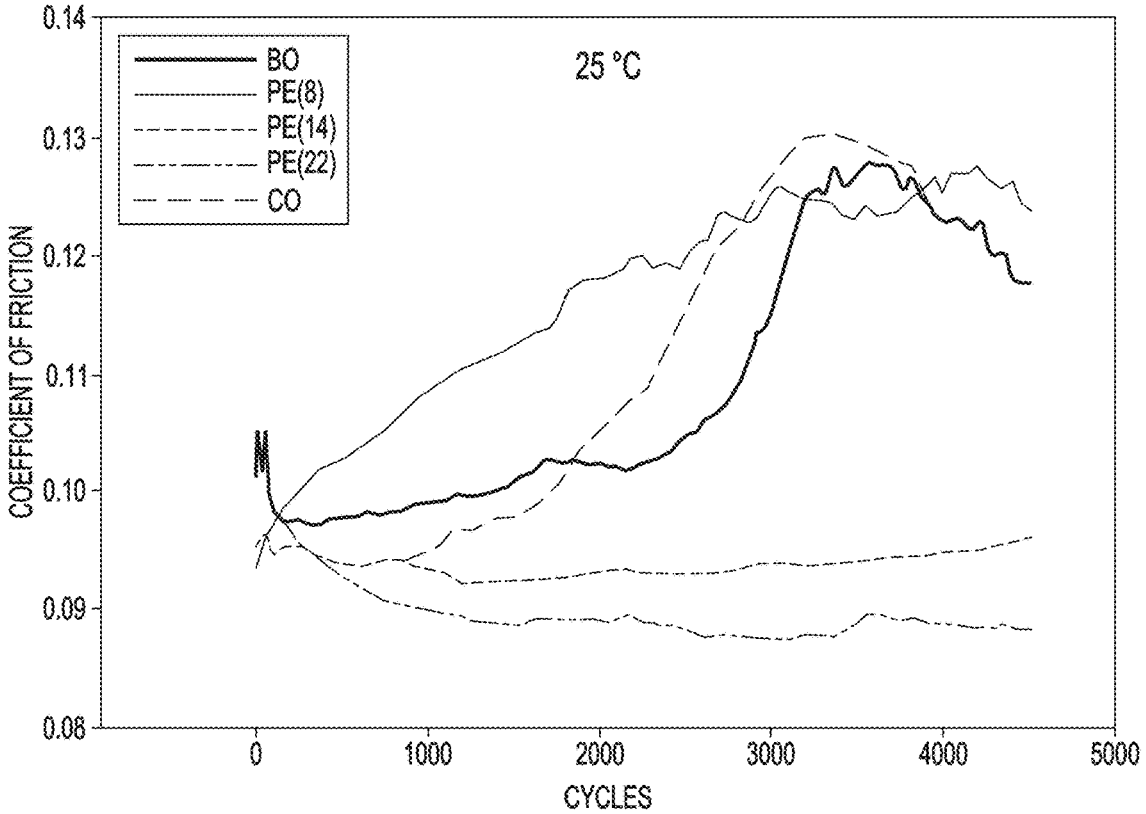
FIGS. 4A-B illustrate average coefficients of friction for a SiC-steel interface lubricated by 1 wt % of various pyrone ester blends, in accordance with various embodiments.
Figure 4B:
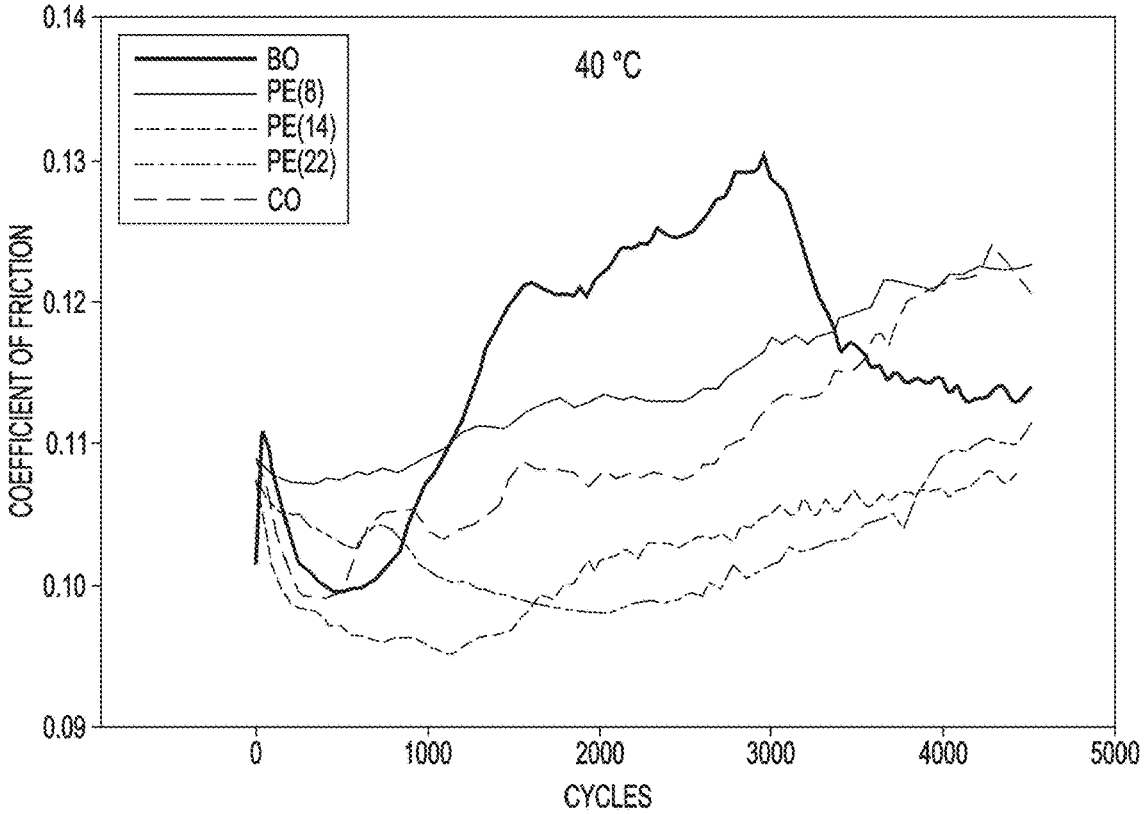
Figure 5A:
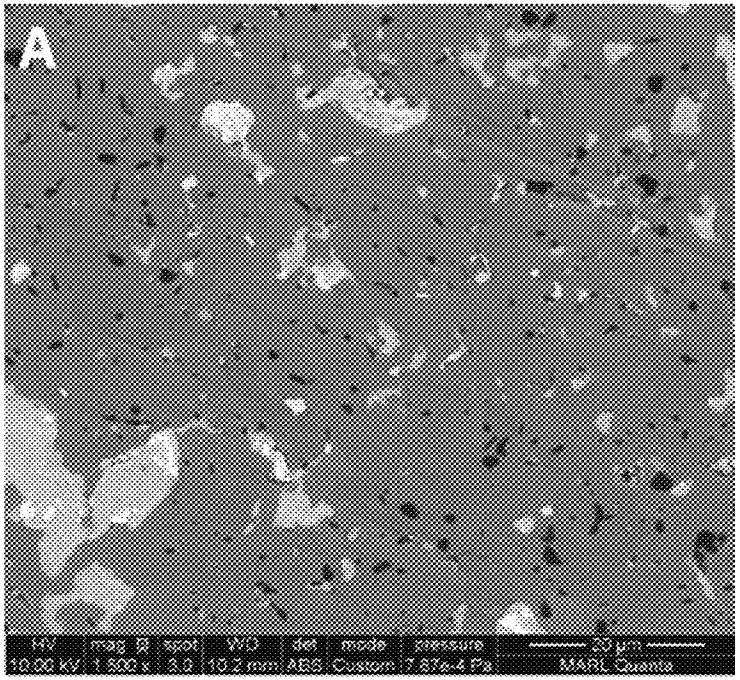
FIGS. 5A-B show backscattered-electron (BASE) imaging of SiC probes lubricated by (A) base oil and (B) PE(8) coumalate, in accordance with various embodiments.
Figure 5B:
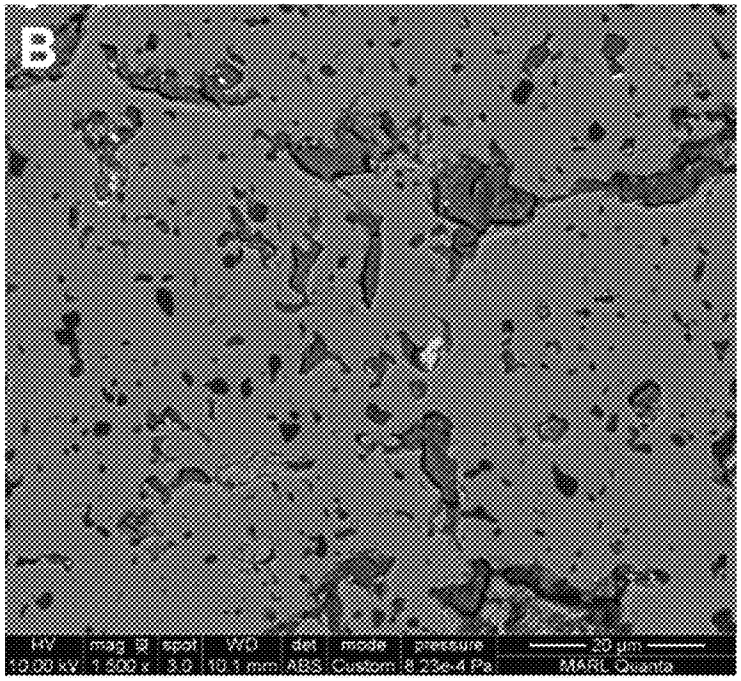
Figure 6A:
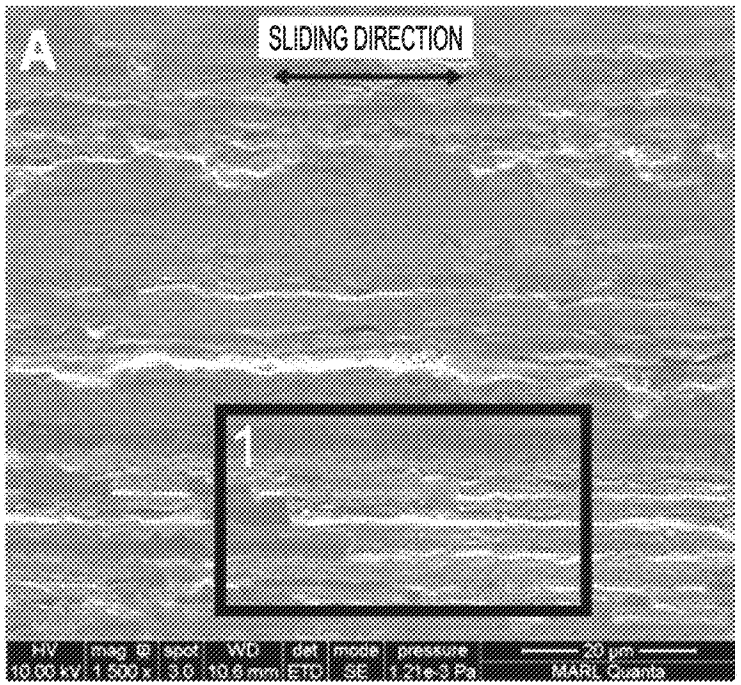
FIG. 6A-B illustrate scanning electron microscope (SE) images of wear scars generated by (A) base oil and (B) PE(8) coumalate, in accordance with various embodiments.
Figure 6B:
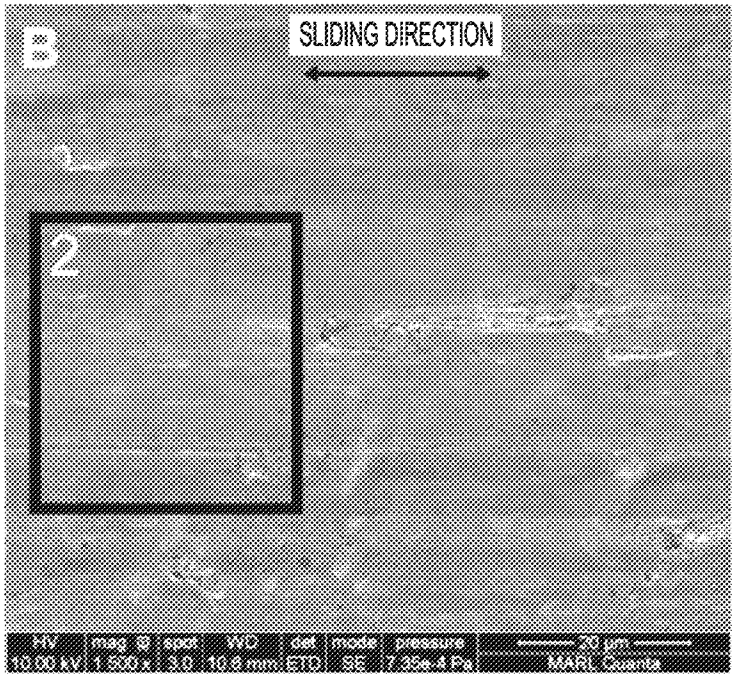

Results illustrating the time evolving friction behavior of the ester blends are shown in FIGS. 4A-B, which shows average coefficients of friction for a SiC-steel interface lubricated by 1% by weight ester blends at 25 and 40° C. over 4500 cycles. Values obtained for the base oil are shown for comparison. Averages are constructed from three replicate tests. In all cases, there was a brief run-in period that occurred over the first couple hundred cycles. At both temperatures, the two longer chain length esters PE(14) and PE(22) demonstrated the lowest coefficients of friction (COF) in comparison to the control. At 25° C., PE(14) and PE(22) formed and maintained a stable film that facilitated steady state COF values of 0.094 and 0.088, respectively. In contrast, the base oil (BO) showed a COF that rose from 0.098 to 0.103 before reaching an inflection point around 2000 cycles. At this point, the wear mechanism shifted from primarily an abrasive wear to an adhesive wear. Another shift occurred around 3000 cycles back to abrasive wear, and as a result, the COF leveled off around 0.127—a value consistent with lubricated steel-steel contacts. These transitions were reasoned after analysis of the wear scars and SiC probes provided in FIGS. 5A-B and 6A-B. FIGS. 5A-B show BSE images of SiC probes lubricated by (A) BO and (B) PE(8). FIG. 6A-B illustrate SE images of wear scars generated by (A) BO and (B) PE(8). Indications of adhesive wear (patchy craters) and abrasive wear (striations) are highlighted in boxes 1 and 2 respectively.

Because the probes are slightly porous, steel wear debris can be embedded in the holes. During the run-in process, the substrate asperities are clipped off and collected in the pores. As more and more steel coats the surface of the probe, the interface shifts from a pure SiC-steel interface to a SiC/steel composite-steel interface, which facilitates adhesive wear. Conditions are prime for the embedded steel to form cold welds with the substrate at high-pressure sites where metal on metal contact occurs due to the lack of a protective lubricating film and stripped oxide layer. Wear conditions are further exacerbated because the embedded steel has been work hardened to a greater degree than the freshly exposed steel. Therefore, formed cold welds are more likely to shear in the softer substrate. In contrast, esters have been shown to rapidly replenish surface oxides and thus, mitigate adhesive wear. FIGS. 5A-B shows backscattered electron (BSE) images of probe A and probe B which were lubricated by BO and PE(8), respectively. Clean pores seen as the darker regions are present in the probe lubricated by PE(8) where steel, the lighter regions, are present in the probe lubricated by BO. Accompanying secondary electron (SE) images of the wear scars are shown in FIG. 6A-B. Scar B, which was lubricated by PE(8), is predominantly characterized by long striations in the direction of sliding—indicative of abrasive wear—while scar A lubricated by BO has, in addition to striations, patchy craters which suggests material was pulled out from the substrate surface—an indication of adhesive wear. Abrasive wear dominated both cases yet adhesive wear was more pronounced in scar A. FIGS. 5A-B and 6A-B are representative images of the other cases where adhesive and abrasive wear occurred. That is, adhesive wear occurred for the contacts lubricated primarily by BO and CO.

Indeed, comparable behavior was demonstrated by the CO, which indicates the low polarity ester did not sufficiently interact with the substrate surface and did not form a film. Instead, it is likely that a majority of the CO remained in the bulk. Lastly, the COF for PE(8) gradually rose over the entire testing duration from around 0.100 to final values similar to the final values measured with the CO and BO. The lack of a hard transition suggests the additive was present on the substrate surface and a film was formed. Albeit, the generated film was not thick enough to completely protect the surface. As a result, abrasive wear increasingly deteriorated the surface and raised the roughness within the scar, which would have contributed to a rise in friction over the testing period.

Similar friction behavior can be witnessed at 40° C. as seen at the lower temperature. However, the transitions from abrasive to adhesive wear and back again occurred much sooner for the BO (around 800 cycles) since the viscosity was lower. Such conditions made the substrate more prone to wear. PE(8) responded nearly the same as before while PE(14) and PE(22) displayed symptoms that plagued their shorter chain length partner. For the two longer chain length esters, the friction gradually rose from around 0.100 to 0.110. This indicates that a coherent film was generated, but it was not completely sufficient to protect the surface. Overall, the friction behavior was slightly less predictable at the higher temperature due to insoluble, oxidized lubricant deposits that formed within the contacts lubricated by BO, CO, and PE(22). These brown deposits were first observed visually.

Figure 7A:
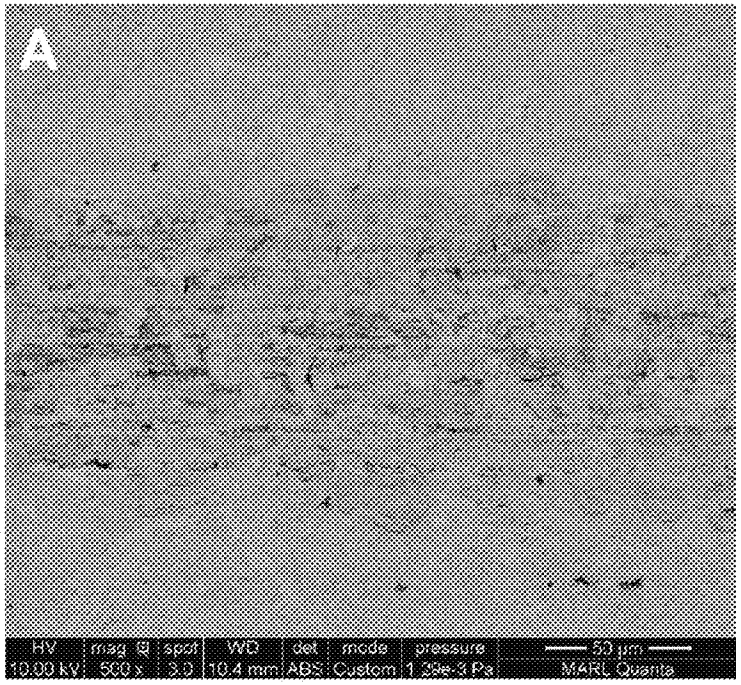
FIGS. 7A-B illustrate BSE images of wear scars generated by (A) PE(14) coumalate and (B) a commercial oil at 40° C., in accordance with various embodiments.
Figure 7B:
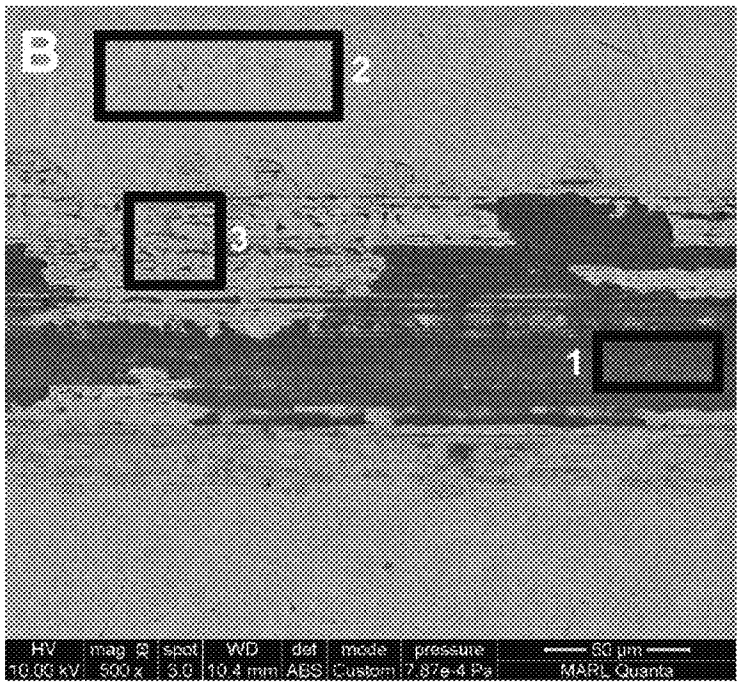
Figure 8:
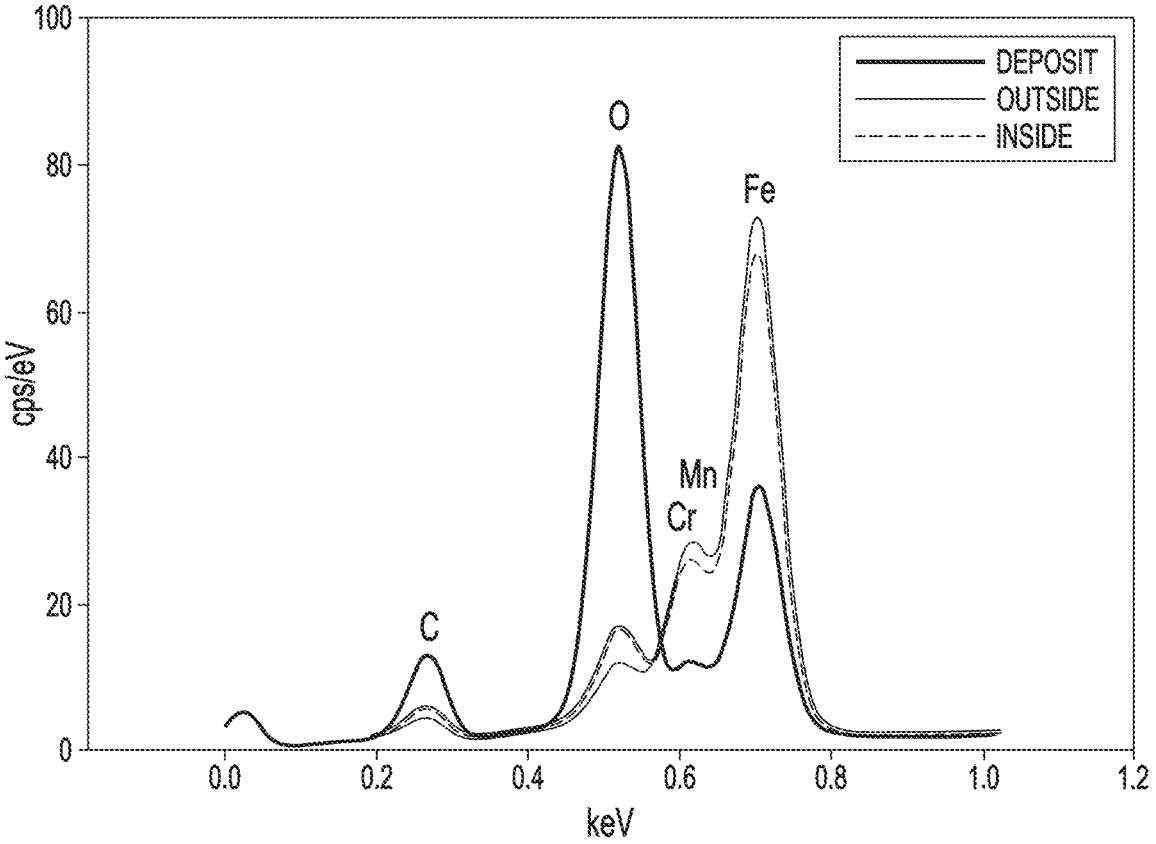
FIG. 8 illustrates energy dispersive spectroscopy (EDS) spectra from three areas in proximity to the wear scar generated by a commercial oil at 40° C., in accordance with various embodiments.

Further evidence that these formations were in fact oxidized lubricant deposits is presented in FIGS. 7A-B, 8, and 9A-B. FIGS. 7A-B illustrate BSE images of wear scars generated by (A) PE(14) and (B) CO at 40° C. The BSE image of the wear scar lubricated by CO contains a large dark patch that represents a different chemical composition than the substrate whereas the image of the wear scar lubricated by PE(14) remains clear of this dark patch. Energy-dispersive X-ray Spectroscopy (EDS) was performed to elucidate the composition of the dark region, and the results are shown in FIG. 8. FIG. 8 illustrates EDS spectra from three areas in proximity to the wear scar generated by CO at 40° C. Three zones were chosen from FIG. 7B to gather EDS data: (1) directly on the deposit, (2) outside the wear scar, and (3) inside the wear scar. Given that the device parameters were the same between each zone, significantly more oxygen was discovered in the dark region, Zone 1, compared to the areas inside and outside the wear scar, which served as backgrounds. In addition, the dark region is characterized by a greater amount of carbon, yet more noteworthy, is the fact that the iron peak is roughly half that of the background peaks. This could signify one of two scenarios: either the dark region is thicker than the beam's interaction depth and contains lower amounts of iron, or more likely, there is material sitting on top of the wear scar and the beam is exciting the underlying substrate.

Figure 9:
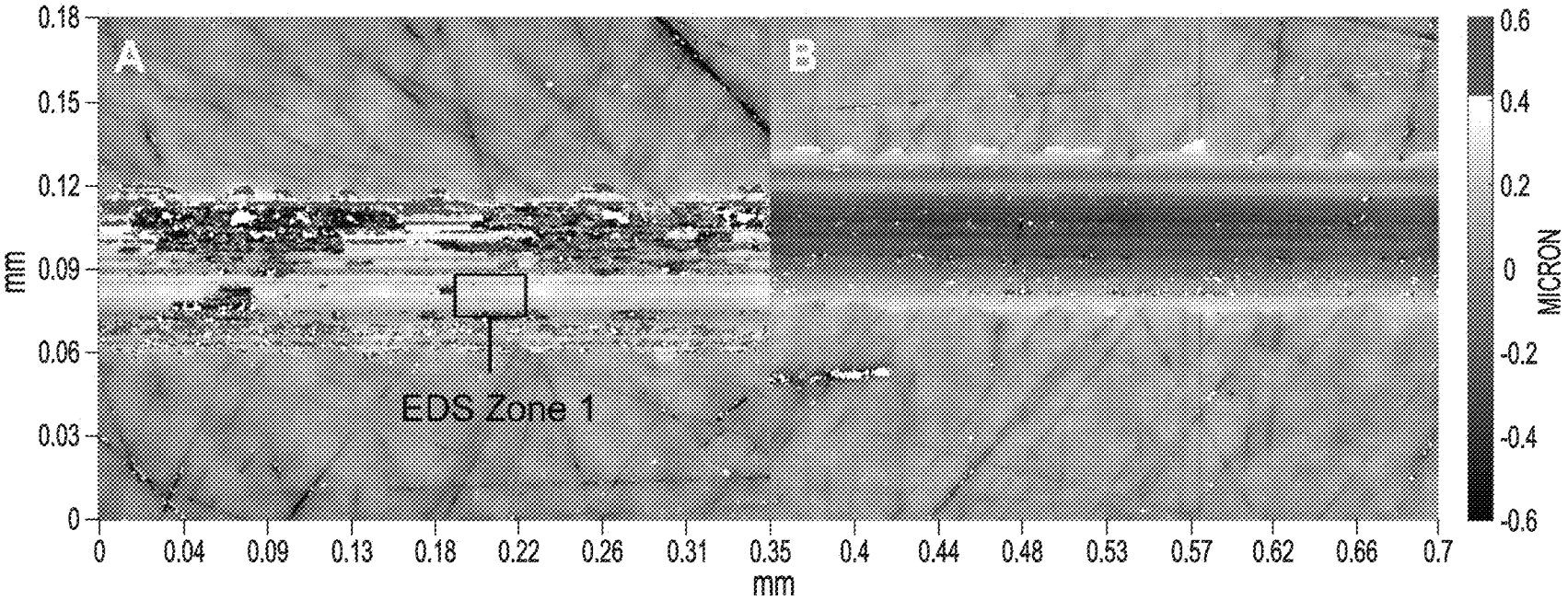
FIGS. 9A-B illustrates topographic data from wear scars generated at 40° C. by (A) a commercial oil and (B) PE(14) coumalate, in accordance with various embodiments.

An estimate of the interaction depth for pure iron by entering the electron beam and material parameters into Castaing's formula equates to a depth of about 0.45 μm. From this depth, Lα photons (0.705 keV) can be generated and measured. Using a Zygo optical profilometer, topographic data was collected to quantify the height of the dark region as seen in FIG. 9A. FIGS. 9A-B illustrate topographic data from wear scars generated at 40° C. by (A) CO and (B) PE(14). Heights greater than the electron beam's interaction depth are highlighted in red. The average height of Zone 1 was about 0.2 μm above the substrate plane, which indicates that material in the dark regions from FIG. 7B was deposited onto the substrate. As mentioned earlier, these oxidized lubricant deposits influenced the friction behavior.

Figure 10A:
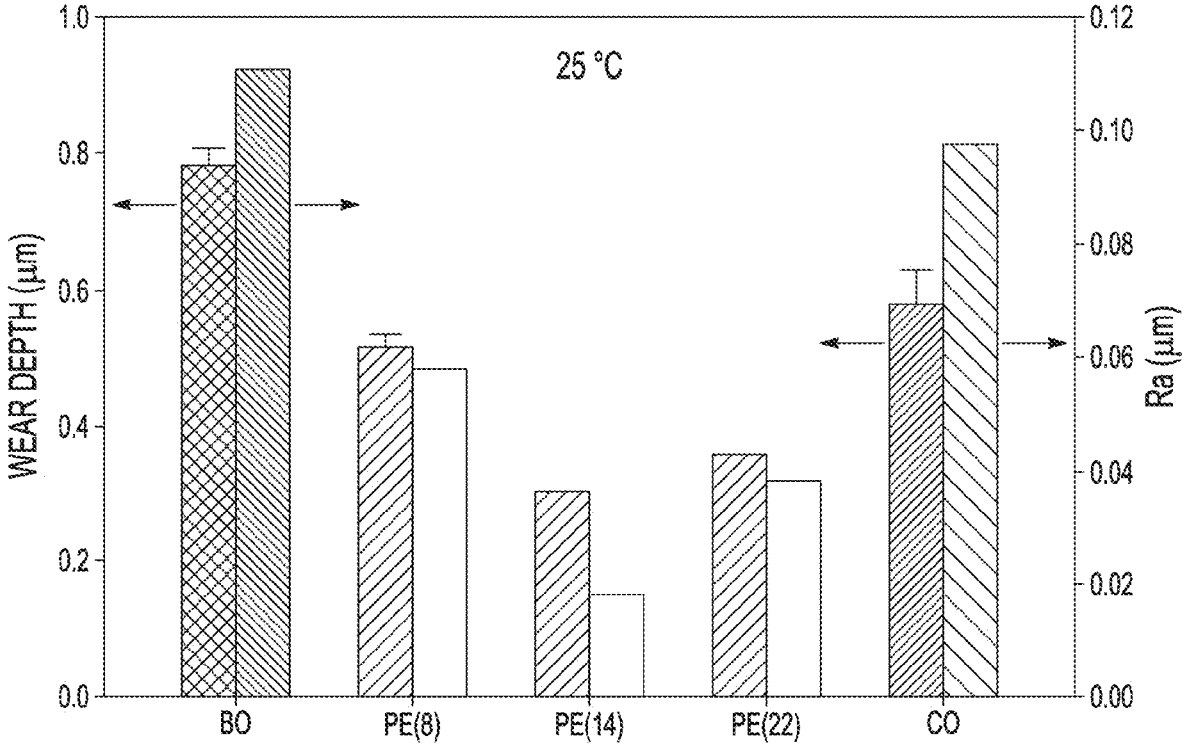
FIGS. 10A-B illustrate the average maximum wear depth and roughness ($R_a$) for the ester blends compared to neat base oil, in accordance with various embodiments.
Figure 10B:
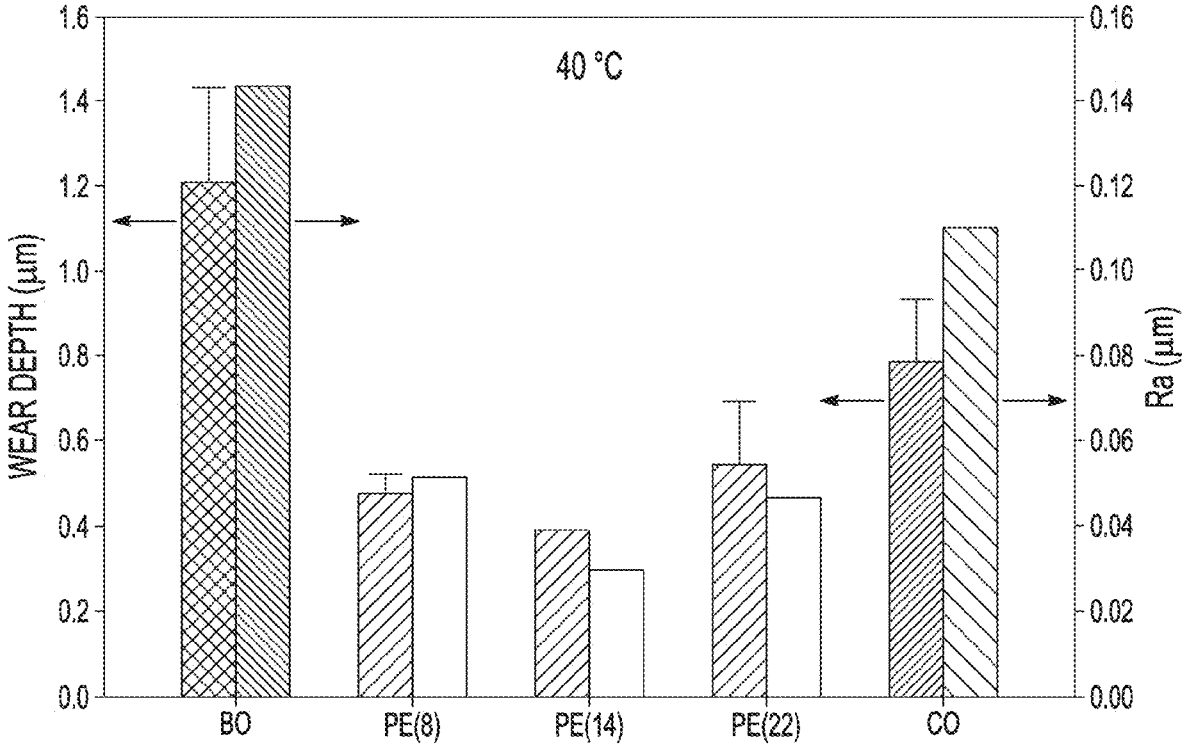

In addition, the deposits introduced greater variability when calculating the average wear depth of each scar. This is evident by looking at the confidence intervals in FIG. 10A-B, which show the average maximum wear depth for all the samples. FIGS. 10A-B illustrate the average maximum wear depth and Ra roughness for the ester blends compared to neat BO. Left and right bars correspond to left and right vertical axes, respectively. Averages based on roughly ten measurements along three wear tracks per treatment. 90,% confidence intervals are shown. For the cases in which deposits were formed (at 40° C.: BO, PE(22), CO and at 25° C.: CO), the variance and subsequently the confidence interval increased depending on the degree to which the deposits covered the wear scar surface. FIGS. 9A-B displays the contrast between two wear scars: one covered in deposits (Scar A) and the other clear of deposits (Scar B). Scar B shows a consistent track that exhibits a typical parabolic profile, whereas the profile of Scar A is inconsistent and patchy. Despite this greater uncertainty, significant differences in anti-wear performance are notable between the treatments. At both temperatures, PE(14) outperformed the other ester blends with an average maximum wear depth of 0.300 μm and 0.385 μm at 25° C. and 40° C., respectively-both reducing the amount wear by over sixty percent with regards to the BO. Combining the average wear depths for all PEs, the amount of wear was more than halved. The same could not be said for the CO, which demonstrated average maximum wear depths of 0.580 μm and 0.783 μm at 25° C. and 40° C., respectively-reducing the amount wear at best by thirty-five percent with regards to the BO. Interestingly, there was a correlation between the surface roughness measured within the scar and the average maximum wear depth as seen on the second vertical axis of FIG. 10. Greater roughness leads to larger pressure spikes and thinner film thickness, which in turn causes more plastic deformation and wear. As the surfaces deteriorated, wear accelerated.

In summary, the tribological behavior of pyrone esters of varying chain lengths was investigated to determine their potential as a green base stock or lubricity additive. It is clear in the case of the esters tested in this study, molecular structure as well as composition played a significant role in the tribological behavior. Changing the polar component of a lubricity additive affects its affinity for the surface as seen between the low polarity CO and relatively higher polarity PEs. Due to the electronegativity of the polar component, the PEs were better able to assemble a robust film within the contact and protect the interfacial surfaces. The length of their ligands also influenced the film thickness and resulting anti-wear performance as in the case of PE(8), which was active at the surface but still suffered more wear in comparison to its longer chain counterpart PE(14). While the longest of the PEs, PE(22), demonstrated friction and wear behavior comparable to PE(14), it also proved to be less oxidatively stable and formed oxidized deposits at the higher testing temperature. Oxidation is more likely at elevated temperatures as displayed in this study. Therefore, more testing is required at higher temperatures such as 100° C.—an industry standard and approximate operating temperature for many mechanical devices such as drivetrains. However, under the testing conditions of this study, PE(14) exhibited superior tribological performance. PE(14) reduced friction by twenty-five percent and reduced wear by over sixty percent with respect to the BO at a low concentration of 1% by weight thus proving its potential as an economic as well as environment friendly lubricant.

Part II. Pyrone and Coumarin Esters and Ethers.

Introduction. It is worth noting the general structure and performance mechanism of chemically active lubricant additives. They contain a polar head, which allows the molecule to adsorb to a surface, and a nonpolar hydrocarbon tail, which grants the molecule its solubility in oil. Strengthening the polarity of the additive increases its affinity for the surface and can be tailored for a given application. This can be achieved by introducing functional groups with greater electronegativity. In addition, the size of the nonpolar tail affects an additive's surface affinity. That is, as the molecular weight ratio between the polar and nonpolar group increases, surface affinity tends to increase but at the cost of solubility. Formulating an oil is a balancing act. To complicate the design process further, various additives such as antiwear agents and detergents 'compete' for adsorption sites on the surface and can interfere with one another. Therefore, antiwear agents should possess higher polarity and thus greater surface affinity in order to give them the edge over other additive competitors so that they may complete their task.

Once antiwear agents have adsorbed onto a steel surface, the mechanism by which they protect steel surfaces revolves around the formation of a sacrificial film. The film acts as a cushion by reducing the induced stress on the underlying substrate and also acts as a barrier that separates two mating surfaces which prevents some asperity interaction. Therefore an effective boundary film must be thick, dense, and possess both strong cohesion and adhesion. However, once pressures do exceed the strength of the material, it is the film that is first to shear away. With the substrate exposed, a new layer of lubricant film can be formed creating a replenishing effect. The adsorption rate of an additive determines how quickly a film can be formed or reformed and is closely linked to tribological performance. Naturally, high rates are associated with better lubricity.

Figure 11:
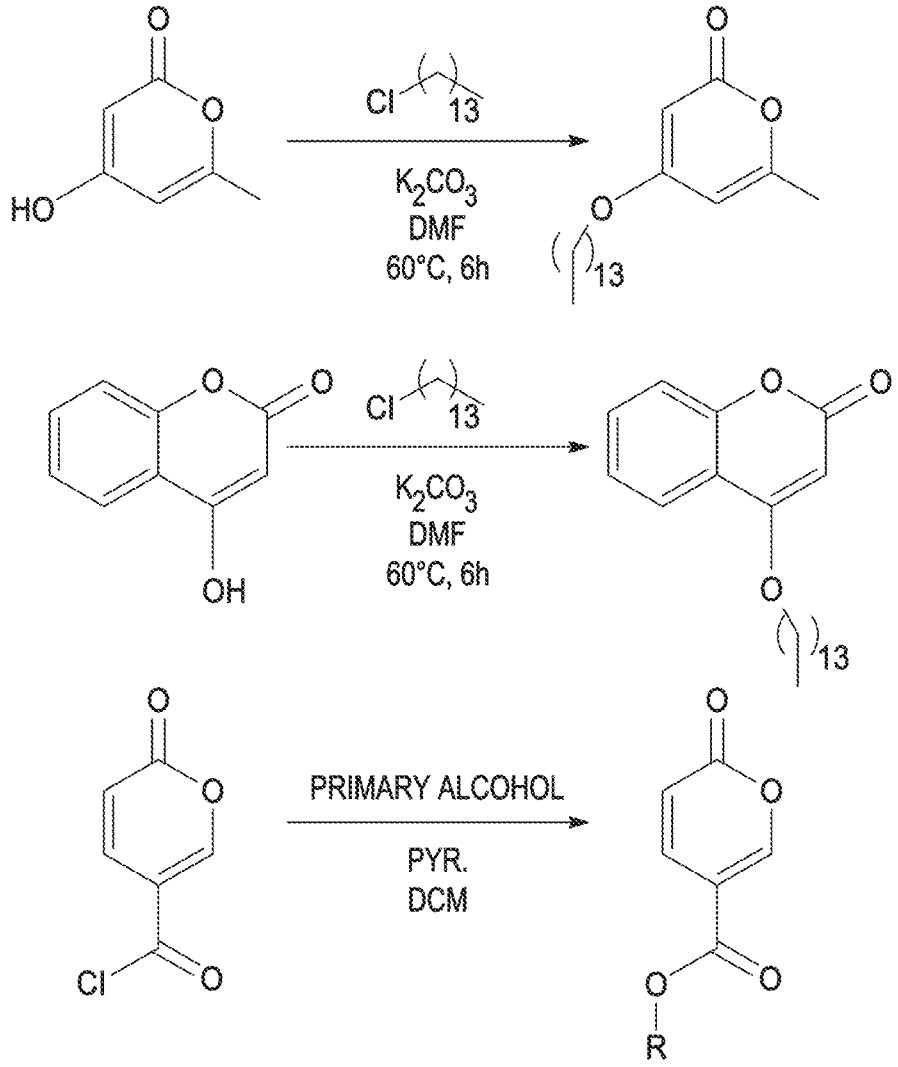
FIG. 11 illustrates a reaction pathway for and molecular structure of various pyrone and coumarin esters, in accordance with various embodiments.

With this background in mind, it was proposed that several changes be made to the PEs formed in Part I. Namely, 1) the surface affinity of the polar head should be increased, 2) special consideration should be given to the potential adsorption rate, and 3) the molecular mass of the nonpolar groups should be reduced while maintaining the well-performing 14 carbon chain length. In order to increase the surface affinity of the previously tested PEs and potentially improve their antiwear behavior, the polar functional group pyrone was modified by adding an additional aromatic ring to form coumarin as seen in FIG. 11 (middle). Measurements and calculations of adsorption energies of polycyclic aromatics on transition metals have been shown to increase with increasing number of rings. From benzene to naphthalene (two linearly fused benzene rings) to anthracene (three linearly fused benzene rings), the energy and thus the affinity for the surface strengthens. While not identical, it stands to reason that a similar trend would exist from pyrone to coumarin, and coumarin would have a greater attraction to a steel substrate. Moreover, the ether moiety will donate electron density into the ring.

In consideration of adsorption rate, it was hypothesized that the double bonded oxygen within the ester group of PE could inhibit adsorption by creating an exclusively preferential surface coordination via steric effects. In detail, due to the double bonded oxygen's negative charge, a PE molecule approaching the surface near the site of a previously adsorbed PE molecule could be repelled to a site farther away if one was available, realigned to a more preferential orientation, or excluded access to the immediate surface all together. By restricting the orientation in which the pyrone molecule adsorbed and by limiting the surface packing density due to increased distances between adsorption sites, the adsorption rate and overall film density would be suboptimal thus curbing the lubricant's antiwear potential. For this reason, two less polar groups with the same 14-carbon chain length, an ether and amine, were explored. Furthermore, these groups were chosen specifically because they reduced the molecular mass of the nonpolar tail. Both amine variants of the molecules found in FIG. 1 (top and middle) suffered from solubility issues. The coumarin amine aggregated in solution producing a cloudy yellow appearance while the TAL amine was completely insoluble. For this reason, the remainder of this Part focuses on the ether compounds and their potential application as an antiwear agent.

Example 5. Synthesis of Pyrone and Coumarin Esters/Ethers

A solution of tetradecylchloride (1.1 equiv) in DMF [0.1 M] was added to potassium iodide (10 equiv.) and cooled to 0° C. Then, potassium carbonate (5 equiv.) and the respective pyrone compound (4-hydroxy-6-methyl-2-pyrone or 4-hydroxycoumarin) (1 equiv.) were added. This solution was heated to 60° C. for 6 h, cooled to room temperature, and diluted with EtOAc. The organic layer was washed with brine, dried ($Na_2SO_4$), concentrated in vacuo, and chromatographed on silica gel (8:1 Hexane/EtOAc) to give a white solid (36% and 38% yields respectively). The reaction pathway and molecular structure of the final products 4-tetradecyloxy-6-methyl-2-pyrone abbreviated TAL(14) and 4-tetradecyloxy coumarin abbreviated Coumarin(14) can be seen in FIG. 11 (top: TAL(14); middle: coumarin(14); and bottom PE(14)). In addition, the pathway and structure of the previously synthesized and tested tetradecyl coumalate abbreviated PE(14) is shown for comparison.

The chemical composition and structure were verified via $^1H$ and $^{13}C$ NMR spectroscopy in conjunction with HRMS. Tetradecyl Coumalate [PE(14)]: $^1H$ NMR (400 MHz, $CDCl_3$) δ: 8.289 (dd, J=2.56, 1.04 Hz, 1H), 7.785 (dd, J=9.8, 2.6 Hz, 1H), 6.337 (dd, J=9.8, 1.04 Hz, 1H), (t, J=6.64 Hz, 2H), 1.713 (m, 2H), 1.256 (m, 22H), 0.876 (t, J=7.04 Hz, 3H); $^{13}C$ NMR (400 MHz, $CDCl_3$) δ: 163.0, 159.9, 157.99, 141.8. 115.3, 112.2, 65.8, 31.9, 29.7, 29.6, 29.5, 29.4, 29.2, 25.9, 22.7, 14.2; HRMS (ESI) m/z calculated for $[M+1]^+$ $[C_{20}H_{32}O_4]^+$: 337.2372, found 337.2371. 4-Tetradecyloxy TAL [TAL(14)]: $^1H$ NMR (400 MHz, $CDCl_3$) δ: 5.75 (dd, J=2.56, 0.88 Hz, 1H), 5.36 (d, J=2 Hz, 1H), 3.91 (t, J=6.52 Hz, 2H), 2.19 (s, 3H), 1.74 (m, 2H), 1.25 (m, 24H), 0.87 (t, J=7 Hz, 3H); $^{13}C$ NMR (400 MHz, $CDCl_3$) δ: 170.1, 162.4, 163.3, 100.6, 87.6, 68.8, 63.1, 44.8, 32.8, 31.9, 29.6, 29.4, 29.3, 28.4, 26.7, 25.7, 23.1, 22.6, 19.8, 14.1; HRMS (ESI) m/z calculated for $[M+1]^+[C_{20}H_{34}O_3]^+$: 323.5234, found 323.5233. 4-Tetradecyloxy Coumarin [Coumarin(14)]: $^1H$ NMR (400 MHz, $CDCl_3$) δ: 7.85 (dd, J=7.92, 1.56 Hz, 1H), 7.57 (td, J=8.76, 6.88, 1.64, 1.44 Hz, 1H, 7.31 (m, 2H), 5.69 (s, 1H), 4.15 (t, J=6.44 Hz, 2H), 1.95 (m, 2H), 1.28 (m, 24H), 0.90 (t, J=7 Hz, 3H); $^{13}C$ NMR (400 MHz, $CDCl_3$) δ:166.2, 162.4, 153.1, 132.2, 123.8, 123.0, 116.7, 90.3, 69.4, 59.2, 43.7, 40.0, 31.9, 30.7, 30.1, 29.5, 29.2, 28.4, 28.1, 25.9, 25.7, 22.6, 14.1; HRMS (ESI) m/z calculated for $[M+1]^+$ $[C_{23}H_{34}O_3]^+$: 359.4357, found 359.4356.

Example 6. Tribological Testing

All synthesized lubricant additives were blended at 1% by weight into a commercially available isoparaffinic API Group III mineral base oil (NEXBASE 3043) and found to be readily soluble. The effectiveness of these blends was compared to two fully formulated 5W-20 engine oils: one a conventional oil (Castrol GTX) and the other a full synthetic oil (Castrol EDGE). Technical data supplied by the manufacturer for all commercially available oils has been provided in Table 3.

TABLE 3

Manufacturer-reported physical properties for commercial oils Castrol GTX 5W-20, Castrol EDGE 5W-20, and the base oil NEXBASE 3043.

| Property | GTX | EDGE | Base Oil |
|---|---|---|---|
| Kinematic viscosity ($mm^2/s$) | | | |
| 40° C. | 52.98 | 44.6 | 20 |
| 100° C. | 9.1 | 8.2 | 4.3 |
| Viscosity index | 154 | 160 | 122 |
| Pour Point | −42° C. | −42° C. | −18° C. |
| Flash Point | 226° C. | 225° C. | 228° C. |
| Density, at 15° C. (g/ml) | 0.862 | 0.850 | 0.837 |

For an accurate comparison, tribological testing was conducted in the same manner as done in Part I. That is, reciprocating tests were used to characterize both friction and wear behavior of the ether blends and engine oils at 40° C. under boundary lubrication. Neat mineral oil served as the control. The testing device is a custom ball-on-flat microtribometer as seen in FIG. 3 and was operated in conjunction with a temperature-controlled stage. In brief, precise normal loading of a probe onto the sample substrate is performed via software controlled linear stages. The sample substrate is forced to slide against the probe and subsequent lateral or frictional forces are measured. The temperature-controlled stage consists of an aluminum block that contains an oil reservoir. The block's temperature is monitored and controlled via an adhesive thermocouple connected to a PID controller. In addition, the oil temperature is monitored with a thermistor. Prior to testing, all lubricants were agitated to ensure homogeneous blends. Then, the reservoir was filled with an equal volume, and the oil temperature was equilibrated to 40° C. The oil level sits just above the substrate surface so there is a constant supply of oil into the contact zone.

For the friction and wear testing, a SiC-steel interface consisting of a 4 mm diameter silicon carbide ball on an AISI 8620 steel substrate was chosen. The ceramic was chosen for its superior hardness relative to the substrate in order to isolate the majority of the wear to the substrate and preserve the probes geometry. In this way, a consistent contact pressure can be maintained. A constant normal load of 3.4 N (maximum Hertzian pressure of 1.5 GPa) was applied as the substrate was translated at a rate of 10 mm/s over an 8 mm stroke length for 4,500 cycles. The substrate was isotropically polished to a finish of 0.031±0.003 μm Ra determined from nine 1.41 mm×1.88 mm scans using a Zygo optical profilometer. Estimates based on EHL theory, measured surface roughness, applied load, and provided viscosity parameters placed this study well within the boundary lubrication regime as the estimated A ratio was much less than one.

After test completion, the substrate and probes were cleaned with denatured ethanol before undergoing SEM and EDS analysis. In addition, the substrate wear scars were scanned using a Zygo optical profilometer. Eight to ten unique scan areas were gathered to capture the entire length of each scar. All topographic and force data was then imported into MATLAB where the average wear depth and coefficient of friction was calculated. Three replicate tests were completed for each treatment.

Example 7. Results and Discussion

Figure 12:
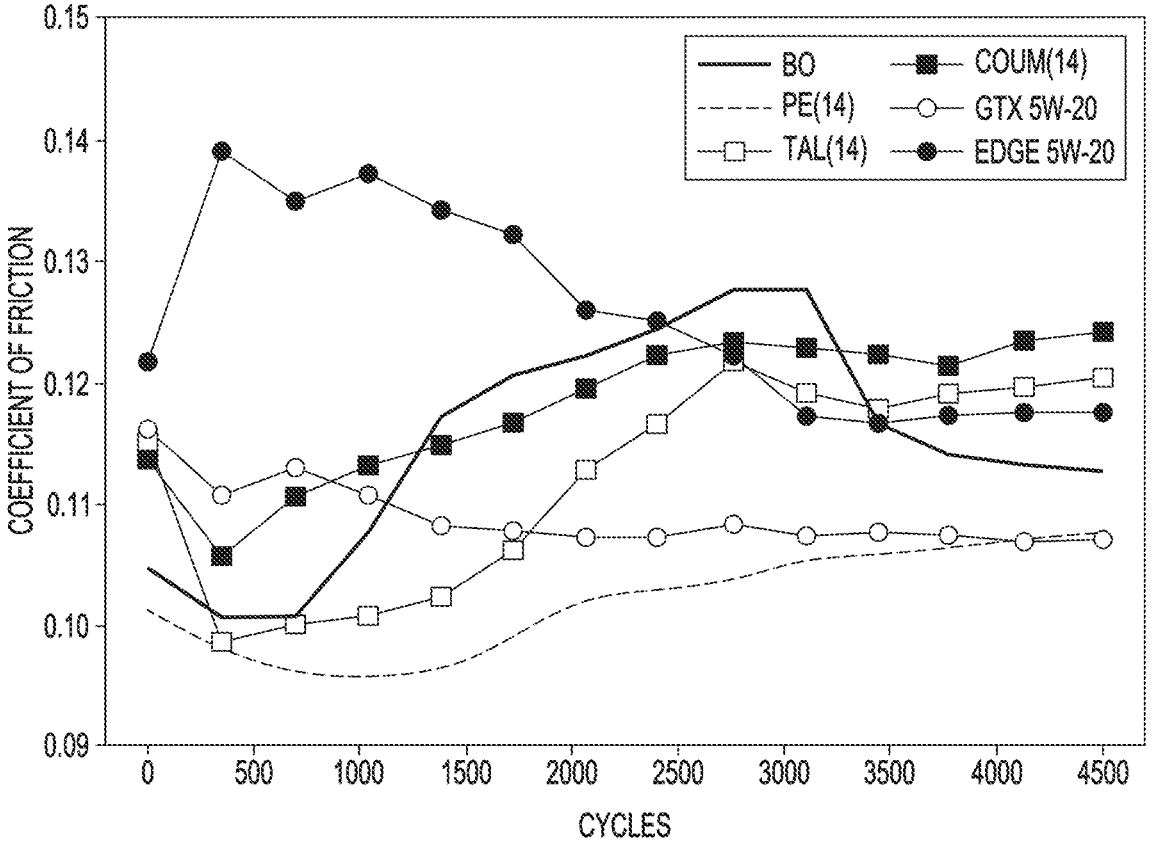
FIG. 12 illustrates average coefficients of friction for a SiC steel interface lubricated by 1% by weight ester and ether blends at 40° C. over 4,500 cycles, in accordance with various embodiments.

The time dependent friction response can be seen in FIG. 12. FIG. 12 illustrates average coefficients of friction for a SiC-steel interface lubricated by 1% by weight ester and ether blends at 40° C. over 4,500 cycles. Values obtained for the neat base oil and two fully formulated 5W-20 engine oils are shown for comparison. Averages are constructed from three replicate tests.I n all cases, there was a brief run-in period that occurred over the first couple hundred cycles as indicated by the rapid change in coefficient of friction. Over the course of the entire 4,500 cycles (approximately two hours of testing), the final coefficient of friction (COF) increased from its initial value for all lubricants with the exception of both fully formulated oils in which friction ultimately decreased. For the synthesized ester and ether blends, the overall increase in friction is precursed by an initial decrease. Values as low as 0.100 and 0.105 were observed for TAL(14) and Coumarin(14), respectively, while PE(14) demonstrated the lowest COF out of all the tested lubricants—even the fully formulated oils—at 0.094. This familiar trend suggests that a coherent boundary lubrication film was generated, but it was not completely sufficient to protect the surface. As a result, the surface progressively degraded and localized roughness (measured on the scale of the estimated contact radius) within the contact zone increased. Increased roughness leads to localized points of high pressure at asperities, which tests the limits of the boundary film's strength. Therefore, the increase in friction—the required force to shear the mating surfaces—can be reasoned by an increase in asperity interaction. On a related note, the different magnitudes in the COF between the synthesized ether and ester blends correlate with their adsorption energies. Coumarin(14) binds to the surface more strongly than TAL(14) which binds more strongly than PE(14), and therefore, the relative difficulty to shear each compound varies accordingly.

Figure 13A:
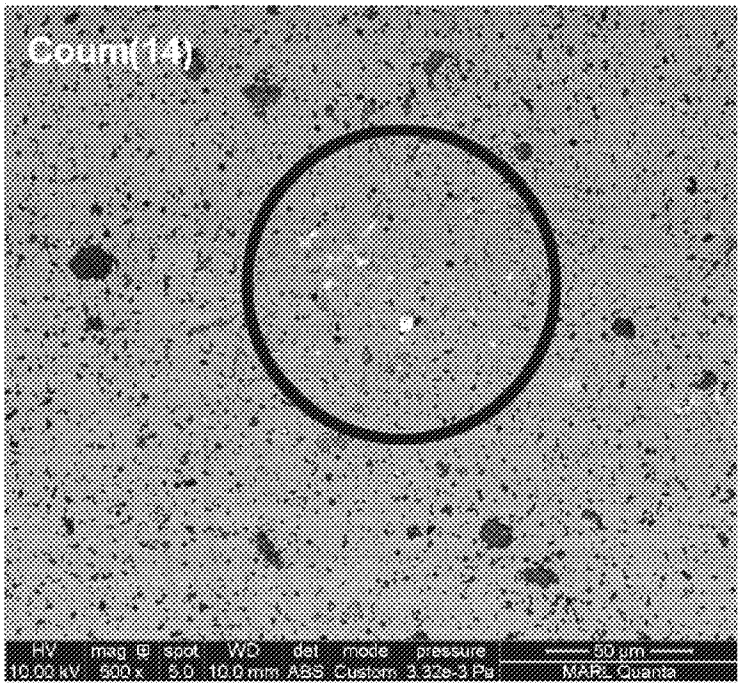
FIGS. 13A-B illustrate backscattered electron images of SiC probes used to generate wear scars for contacts lubricated with coumarin(14) (4A) and GTX 5W-20 (4B), in accordance with various embodiments.
Figure 13B:
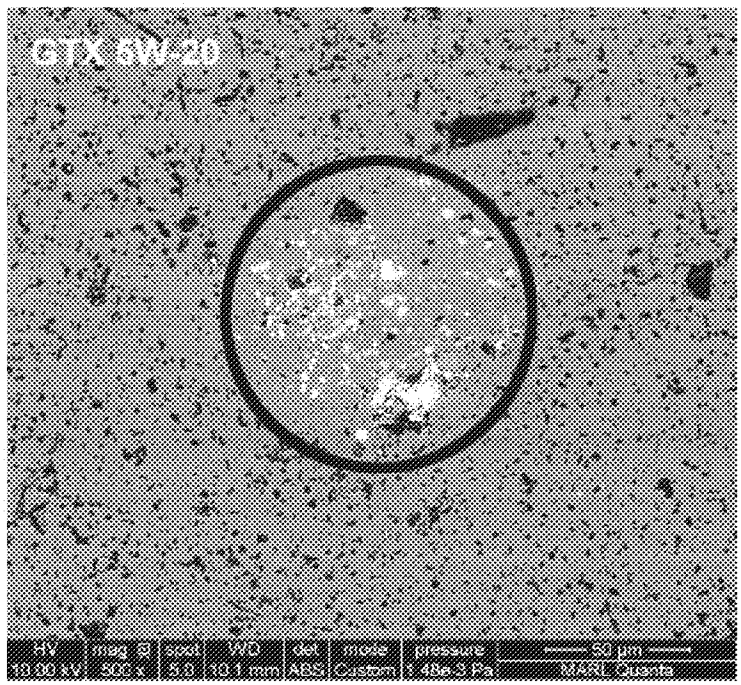

Another contributing factor to the increase in observed COF for the synthesized additives is the probable case that as the sacrificial lubricant film was repeatedly sheared away and subsequently replenished, the bulk additive concentration was depleting. A declining concentration would have an adverse effect on the adsorption rate. That being said, the concentration was not completely depleted, and a boundary film was always present as evidenced by FIGS. 13A-B. FIGS. 13A-B illustrate backscattered electron (BSE) images of the SiC probes used to generate scars lubricated by Coumarin(14) (4A) and GTX 5W-20 (4B). Due to the slightly porous nature of the probes, steel wear debris can be embedded. Bright regions in the BSE images correspond to embedded steel from the substrate. The contact area is circled for clarity. The proclivity to capture wear debris was much more significant with the fully formulated oils in comparison to the synthesized additives. This process is more prevalent during the run-in process where substrate asperities are sheared off and collected in the pores. However, the lack of embedded steel in the probes lubricated with the ether and ester blends suggests that a boundary lubrication film was rapidly formed, and thus throughout the testing duration, direct contact between the probe and substrate was limited.

Figure 14:
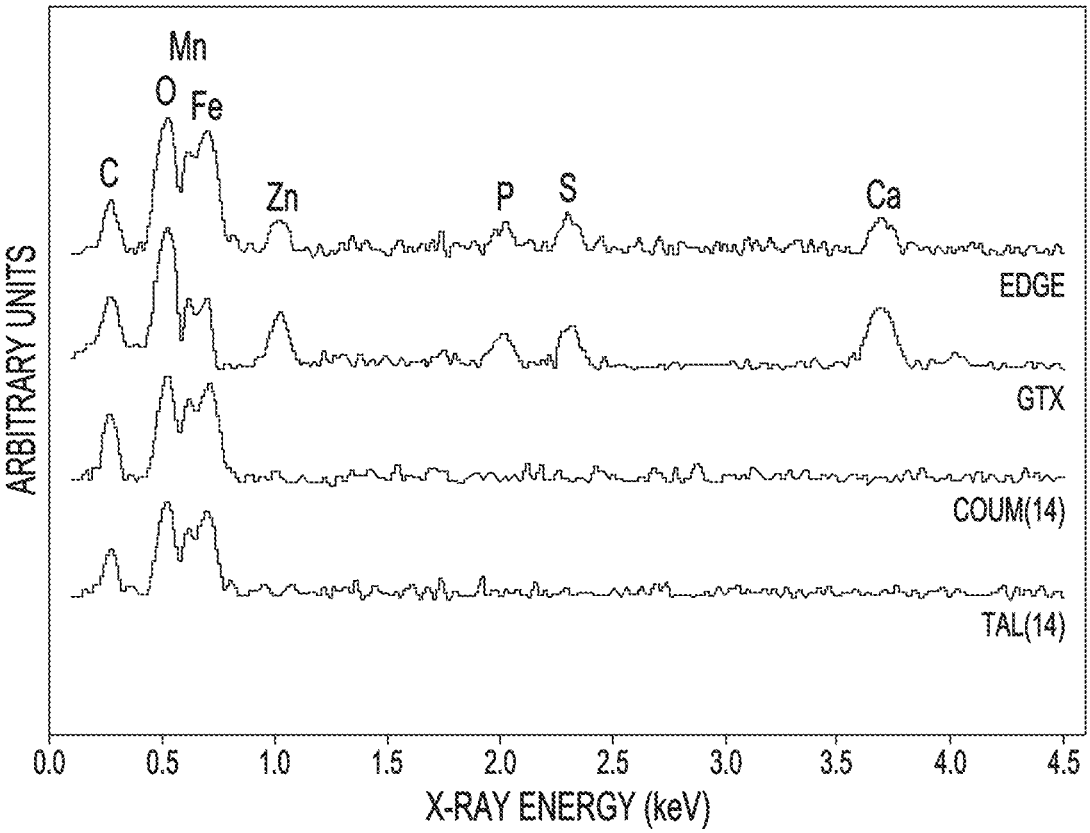
FIG. 14 illustrates EDS spectra showing the absolute relative difference between regions located inside and outside of the generated wears scars for the ether blends, ester blend, and two fully formulated oils, in accordance with various embodiments.

In contrast, the probes lubricated by the fully formulated oils show remarkably more embedded steel, yet over time the friction coefficient declined. Before discussing the underlying mechanisms behind the friction response for the fully formulated oils, it should be noted that upon EDS analysis of the wear scars and probes, zinc, phosphorus, sulfur, and calcium were detected as seen in FIG. 14. FIG. 14 illustrates EDS spectra showing the absolute relative difference between regions located inside and outside of the generated wears scars for the ether blends, ester blend, and two fully formulated oils. The count rate has been plotted on an arbitrary log scale to highlight the lower count Zn, P, S, and Ca peaks. These peaks indicate the presence of ZDDP and a calcium based detergent within the fully formulated oils. In all cases, greater amounts of Mn and Fe were detected outside of the wear scar and the presence of these peaks is due to shadowing effects. This strongly suggests the presence of two commonly used surface-active additives ZDDP and a calcium sulfonate detergent. Like the ether and ester additives, ZDDP initially physisorbs to the substrate surface. However through the aid of stress-induced mechanical mixing, ZDDP decomposes at temperatures around 100° C., and the resulting products chemisorb to the substrate and form an extremely durable tribofilm consisting of a glassy phosphate structure. The presence of embedded steel in the probes lubricated by the fully formulated oils indicates that formation of the protective boundary lubricant film was delayed relative to the rate of film formation for the ether and ester blends. This delay can be explained in part by the 40° C. testing temperature. Decomposition would begin only after frictional heating within the contact zone led to elevated temperatures. In addition, ZDDP and its decomposition products were competing with other surface-active additives such as the detected calcium sulfonate detergent, which would inhibit adsorption rates and consequently film formation. Only after a coherent film was formed, could the COF reach a steady state. For the GTX and EDGE oils, respectively, a steady state was achieved around 1,500 and 3,000 cycles and average steady state COF values of 0.107 and 0.118 were achieved. Due to the proprietary nature of commercial oils and limitations of EDS, it is unclear whether any other lubricant additives such as a friction modifier aided in the decrease in friction over time. What is also uncertain is the cause for the stark difference in the magnitude between the COF values for GTX and EDGE.

Figure 15A:
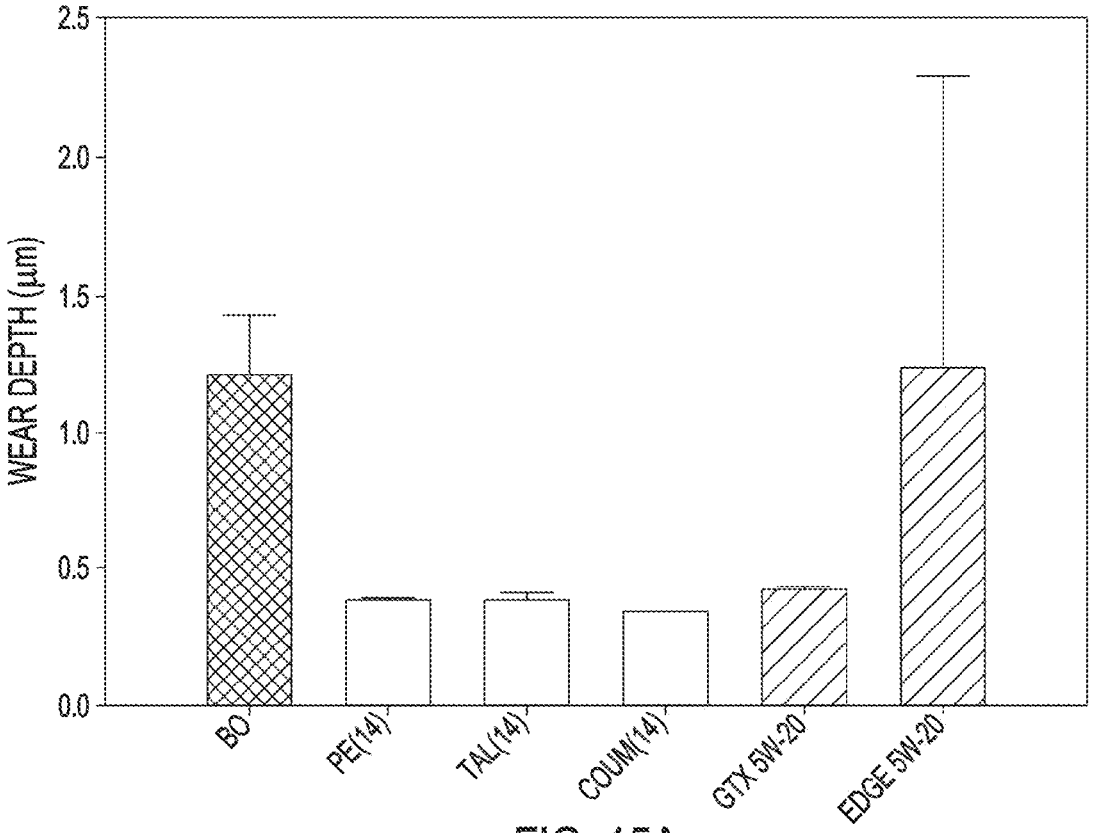
FIG. 15A illustrates average maximum wear depth for the ester and ether blends compared to neat BO and two fully formulated engine oils, in accordance with various embodiments.
Figure 15B:
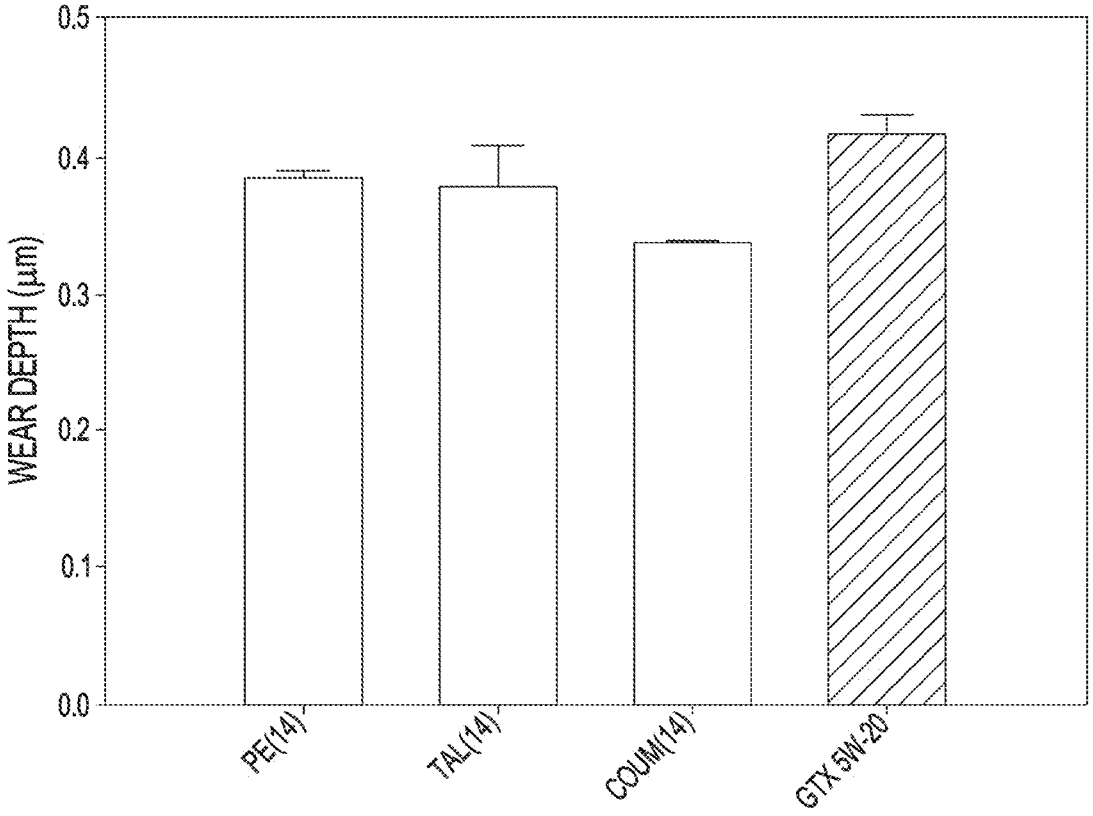
FIG. 15B illustrates best performing lubricants, in accordance with various embodiments.

FIG. 15A illustrates average maximum wear depth for the ester and ether blends compared to neat BO and two fully formulated engine oils. FIG. 15B illustrates best performing lubricants shown on smaller scale for clarity. In FIGS. 15A-B, averages based on ten measurements along three wear tracks per treatment, and 90% confidence intervals are shown. While friction and wear are not inherently correlated, the anomalous difference in tribological behavior between the two fully formulated oils is consistent when examining the average depth of the generated wear scars. FIG. 15A depicts the drastic difference between the scars lubricated by the fully formulated oils with GTX and EDGE showing average wear depths of 1.237 μm and 0.418 μm, respectively. In comparison, EDGE performed worse than the neat base oil (1.207 μm). More importantly, however, was the fact that both synthesized ether blends TAL(14) (0.380 μm) and Coumarin(14) (0.338 μm) showed improvement over the previously tested PE(14) (0.385 μm). Coumarin(14) showed the greatest improvement at 12%. Better still, all three synthesized antiwear additives outperformed on average the best performing fully formulated oil. This can be seen clearly in FIG. 15B. Indeed, the ether blends demonstrated their potential as antiwear additives by rapidly forming a sacrificial boundary lubrication film, which minimized direct contact between the mating surfaces and thus, mitigated wear.

Figure 16A:
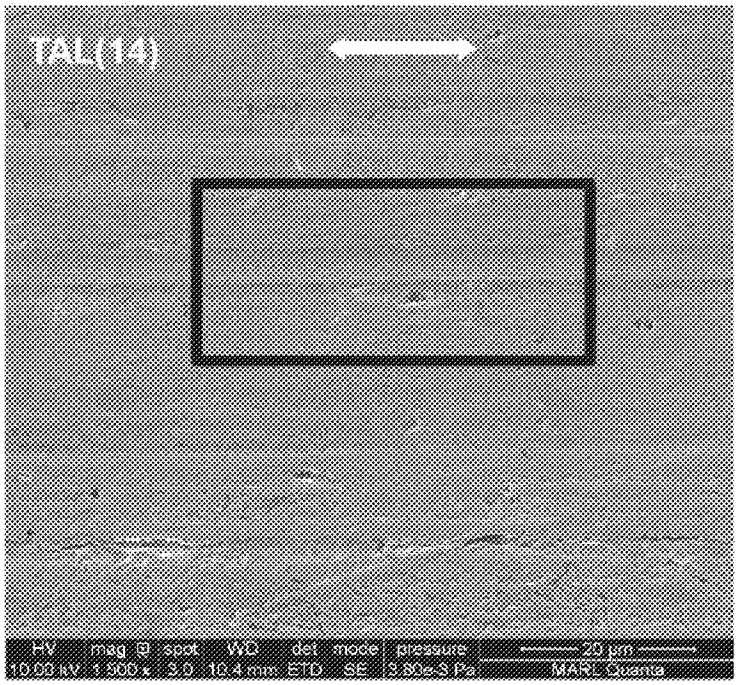
FIG. 16A illustrates secondary electron image of wear scar generated by TAL(14). Indications of abrasive wear are evident as seen by the outlined striations, in accordance with various embodiments.
Figure 16B:
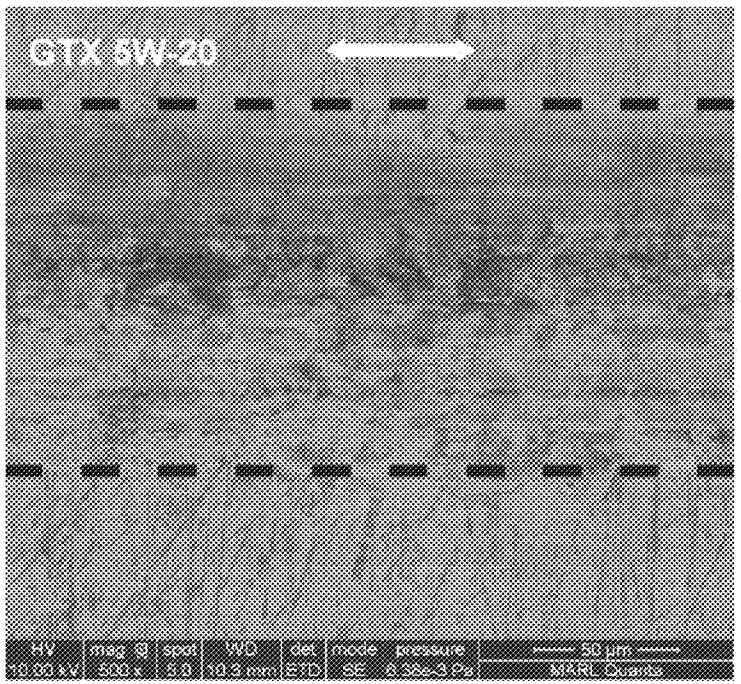
FIG. 16B illustrates secondary electron image of wear scar generated by GTX 5W-20, in accordance with various embodiments.

FIG. 16A illustrates secondary electron image of wear scar generated by TAL(14). Indications of abrasive wear are evident as seen by the outlined striations. FIG. 16B illustrates secondary electron image of wear scar generated by GTX 5W-20. Wear scar edges have been highlighted for clarity. Sliding direction in both cases is indicated by white arrows. Wear was limited to mild abrasion as evidenced in FIG. 16A. The secondary electron image was taken at a magnification of 1500 X within the scar generated by TAL(14). Striations from two-body wear are outlined for clarity and run across the entire image in the direction of sliding. Because the tribofilm was physisorbed and due to the limitations of EDS, whatever remained of the organic tribofilm after cleaning the substrate with denatured ethanol was not directly observable under SEM nor detectable via EDS.

On the other hand, a tribofilm was both observed and detected for the fully formulated oils. FIG. 16B shows a secondary electron image of the wear scar generated by GTX 5W-20 at a magnification of 500 X. The edges of the scar have been highlighted for clarity. Within those bounds, a patchy network of islands consistent with description of a ZDDP tribofilm can be seen. An elemental mapping via EDS illuminated a haphazard dispersion of zinc, phosphorus, sulfur, and calcium throughout the scar. As mentioned prior, there was a delay before the tribofilm fully formed and offered the substrate protection. However, once the film did form, the durable properties of the phosphate glass prevented further material loss. Moreover, the tribofilm was firmly chemisorbed to the surface and resistant to removal by solvent.

In summary, modifications were made to a previously studied lubricant additive pyrone ester with the intention of improving the compound's antiwear behavior. Multiple nonpolar and polar group structures were investigate in combination to different degrees of success. Linear amine structures demonstrated poor solubility in the mineral oil base stock whereas ether structures did not. Rather, they demonstrated improved wear performance over their ester counterpart. The greatest improvement was made by binding an additional aromatic ring to the polar functional group. Changing this group from pyrone to coumarin increased the molecule's surface affinity and provided stronger adhesion to the substrate. This in turn heightened the required shear stress to remove the formed boundary lubrication film. As a result the average coefficient of friction increased slightly, but the achieved trade-off was a 12% gain in wear reduction. Indeed, at an economically meager concentration of 1% by weight, Coumarin(14) outperformed all other tested lubricants including two fully formulated engine oils—a conventional oil (Castrol GTX 5W-20) and a full synthetic (Castrol EDGE 5W-20). It was suspected before testing and concluded after via EDS analysis of the wear scars that the commercial oils contained ZDDP. By showing favorable wear resistance behavior compared to the leading antiwear agent in the lubricant industry, all three synthesized pyrone derivatives demonstrated their market potential as an eco-friendly alternative.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present invention. Thus, it should be understood that although the present invention has been specifically disclosed by specific embodiments and optional features, modification and variation of the concepts herein disclosed may be resorted to by those of ordinary skill in the art, and that such modifications and variations are considered to be within the scope of embodiments of the present invention.

Exemplary Embodiments

The following exemplary embodiments are provided, the numbering of which is not to be construed as designating levels of importance:

Embodiment 1 provides a base oil or lubricant additive having the structure:

I

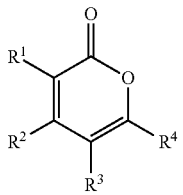

or

II

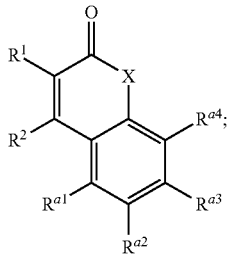

wherein

X is —O— or —NH—, $R^1$, $R^2$, $R^3$, $R^4$, $R^{a1}$, $R^{a2}$, $R^{a3}$, and $R^{a4}$ are independently chosen from —H, —($C_1$-$C_5$)hydrocarbyl and —$R^b$, or the structure is structure II and $R^{a1}$ and $R^{a2}$ together form a fused phenyl ring and $R^1$, $R^2$, $R^{a3}$, and $R^{a4}$ are independently chosen from —H, —($C_1$-$C_5$)hydrocarbyl and —$R^b$, or the structure is structure II and $R^{a3}$ and $R^{a4}$ together form a fused phenyl ring and $R^1$, $R^2$, $R_{a1}$, and $R^{a2}$ are independently chosen from —H, —($C_1$-$C_5$)hydrocarbyl and —$R^b$, the base oil or lubricant additive comprises at least one $R^b$, at each occurrence, $R^b$ is independently chosen from —C(O)—O—$R^c$, —O—$R^c$, —S—$R^c$, and —NH—$R^c$, and at each occurrence, $R^c$ is independently ($C_6$-$C_{30}$)hydrocarbyl that is interrupted by 0, 1, 2, 3, 4, or 5 groups independently chosen from —O— and —S— and that is unsubstituted or substituted with —O—($C_6$-20)aryl.

Embodiment 2 provides the base oil or lubricant additive of Embodiment 1, wherein X is —O—.

Embodiment 3 provides the base oil or lubricant additive of any one of Embodiments 1-2, wherein the base oil or lubricant has the structure I, wherein at least one of $R^1$, $R^2$, $R^3$, and $R^4$ is —$R^b$.

Embodiment 4 provides the base oil or lubricant additive of any one of Embodiments 1-3, wherein the base oil or lubricant has the structure II, wherein at least one of $R^1$, $R^2$, $R^{a1}$, $R^{a2}$, $R^{a3}$, and $R^{a4}$ is —$R^b$.

Embodiment 5 provides the base oil or lubricant additive of any one of Embodiments 1-4, wherein the base oil or lubricant comprises one and not more than one —$R^b$.

Embodiment 6 provides the base oil or lubricant additive of any one of Embodiments 1-5, wherein one of $R^2$, $R^3$, and $R^{a3}$ is —$R^b$.

Embodiment 7 provides the base oil or lubricant additive of any one of Embodiments 1-6, wherein $R^1$, $R^2$, $R^3$, $R^4$, $R^{a1}$, $R^{a2}$, $R^{a3}$, and $R^{a4}$ are independently chosen from —H, —($C_1$-$C_5$)hydrocarbyl, and —$R^b$.

Embodiment 8 provides the base oil or lubricant additive of any one of Embodiments 1-7, wherein $R^1$, $R^2$, $R^3$, $R^4$, $R^{a1}$, $R^{a2}$, $R^{a3}$, and $R^{a4}$ are independently chosen from —H, —($C_1$-$C_3$)hydrocarbyl, and $R^b$.

Embodiment 9 provides the base oil or lubricant additive of any one of Embodiments 1-8, wherein $R^1$, $R^2$, $R^3$, $R^4$, $R^{a1}$, $R^{a2}$, $R^{a3}$, and $R^{a4}$ are independently chosen from —H, methyl, and $R^b$.

Embodiment 10 provides the base oil or lubricant additive of any one of Embodiments 1-9, wherein each occurrence, $R^b$ is independently chosen from —C(O)—O—$R^c$.

Embodiment 11 provides the base oil or lubricant additive of any one of Embodiments 1-10, wherein at each occurrence $R^c$ is independently ($C_6$-$C_{30}$)alkyl.

Embodiment 12 provides the base oil or lubricant additive of any one of Embodiments 1-11, wherein at each occurrence, $R^c$ is independently ($C_5$-$C_{22}$)alkyl.

Embodiment 13 provides the base oil or lubricant additive of any one of Embodiments 1-12, wherein at each occurrence, $R^c$ is independently ($C_{13}$-$C_{15}$)alkyl.

Embodiment 14 provides the base oil or lubricant additive of any one of Embodiments 1-13, wherein at each occurrence, $R^c$ is independently —(($CH_2$—$CH_2$)—O)$_n$—$CH_3$, wherein n is 1 to 10.

Embodiment 15 provides the base oil or lubricant additive of any one of Embodiments 1-14, wherein at each occurrence, $R^c$ is independently —($C_6$-$C_{30}$)alkyl-O-phenyl.

Embodiment 16 provides the base oil or lubricant additive of any one of Embodiments 1-15, wherein at each occurrence, $R^c$ is independently —($C_6$-$C_{30}$)alkyl-O-naphthyl.

Embodiment 17 provides the base oil or lubricant additive of any one of Embodiments 1-16, wherein at each occurrence, $R^c$ is independently ($C_8$)alkyl, ($C_{10}$)alkyl, ($C_{14}$)alkyl, ($C_{15}$)alkyl, or ($C_{22}$)alkyl.

Embodiment 18 provides the base oil or lubricant additive of any one of Embodiments 1-17, wherein at each occurrence, $R^c$ is linear or branched.

Embodiment 19 provides the base oil or lubricant additive of any one of Embodiments 1-18, wherein the base oil or lubricant additive is a base oil.

Embodiment 20 provides the base oil or lubricant additive of any one of Embodiments 1-19, wherein the base oil or lubricant additive is a lubricant additive.

Embodiment 21 provides the base oil or lubricant additive of any one of Embodiments 1-20, wherein $R^1$, $R^2$, $R^3$, $R^4$, $R^{a1}$, $R^{a2}$, $R^{a3}$, and $R^{a4}$ are independently chosen from —H, methyl, and —$R^b$, the base oil or lubricant additive comprises one $R^b$ and not more than one $R^b$, and $R^b$ is —C(O)—O—($C_8$)alkyl, —C(O)—O—($C_{14}$)alkyl, —C(O)—O—($C_{22}$)alkyl, —C(O)—O—($C_{10}$)alkyl, —C(O)—O—($C_{15}$)alkyl, —O—($C_{14}$)alkyl, or —NH—($C_{14}$)alkyl.

Embodiment 22 provides the base oil or lubricant additive of any one of Embodiments 1-20, wherein the base oil or lubricant additive has the structure I, $R^1$, $R^2$, $R^3$, and $R^4$ are independently chosen from —H and —$R^b$, the base oil or lubricant additive comprises one $R^b$ and not more than one $R^b$, and $R^b$ is —C(O)—O—($C_8$)alkyl, —C(O)—O—($C_{14}$)alkyl, —C(O)—O—($C_{22}$)alkyl, —C(O)—O—($C_{10}$)alkyl, or —C(O)—O—($C_{15}$)alkyl.

Embodiment 23 provides the base oil or lubricant additive of any one of Embodiments 1-20, wherein the base oil or lubricant additive has the structure I, $R^1$, $R^2$, $R^3$, and $R^4$ are independently chosen from —H and —$R^b$, the base oil or lubricant additive comprises one $R^b$ and not more than one $R^b$, and $R^b$ is —C(O)—O—($C_8$)alkyl, —C(O)—O—($C_{14}$)alkyl, or —C(O)—O—($C_{22}$)alkyl.

Embodiment 24 provides the base oil or lubricant additive of any one of Embodiments 1-23, wherein the base oil or lubricant additive has one of the following structures:

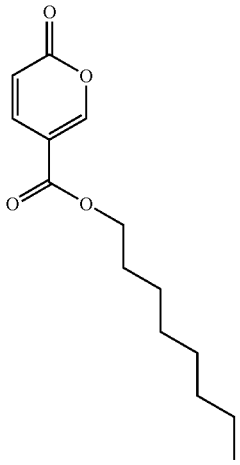

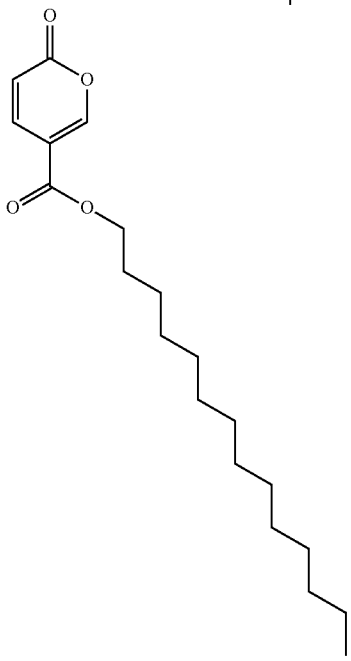

-continued

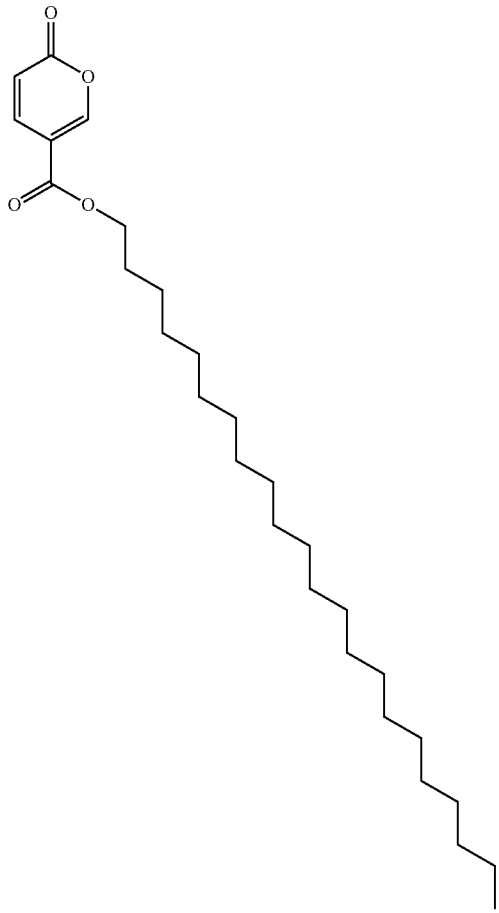

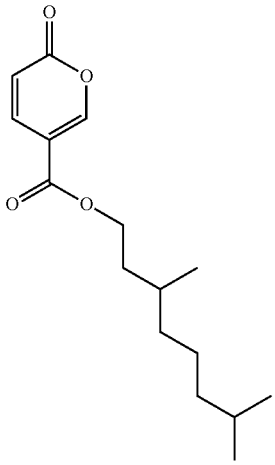

-continued
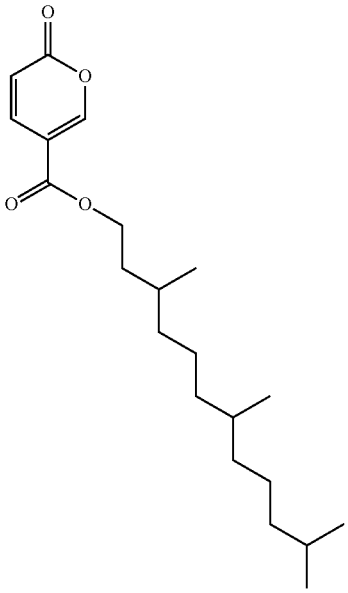
-continued
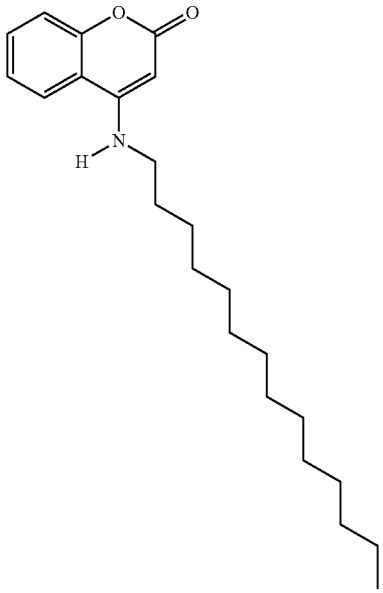
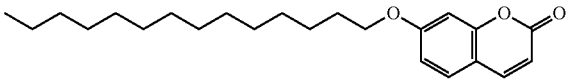
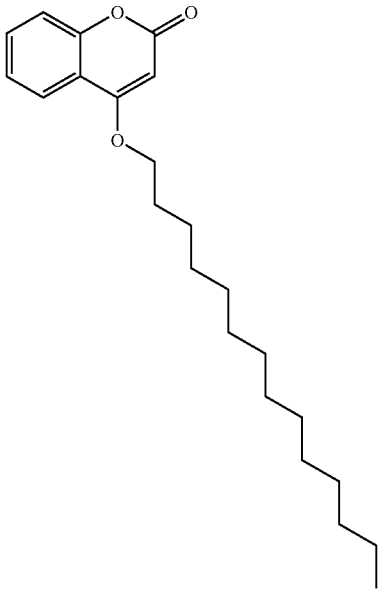
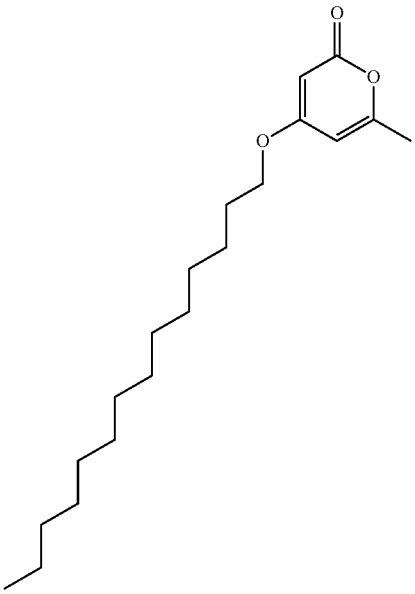
and -continued
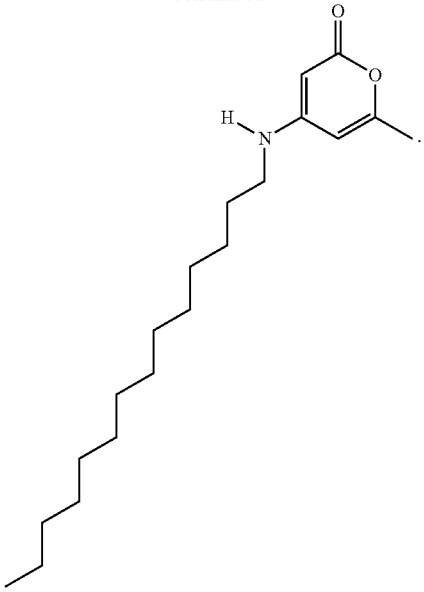
-continued
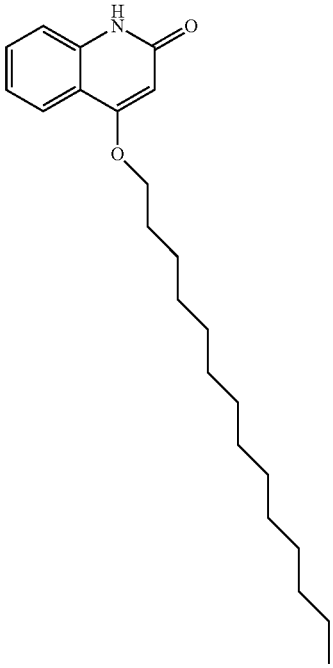
Embodiment 25 provides the base oil or lubricant additive of any one of Embodiments 1-23, wherein the base oil or lubricant additive has one of the following structures:
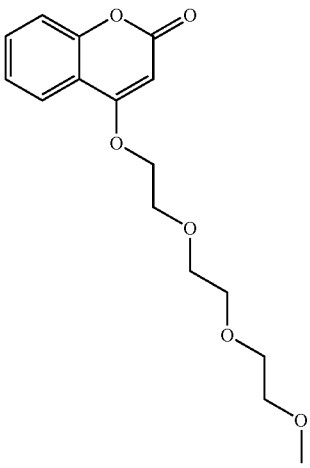
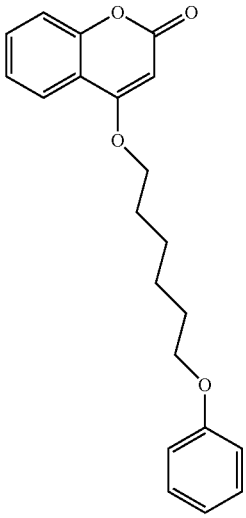
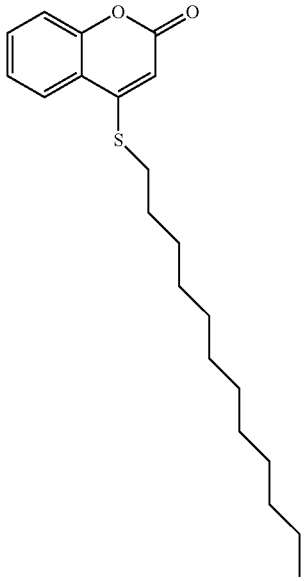

-continued

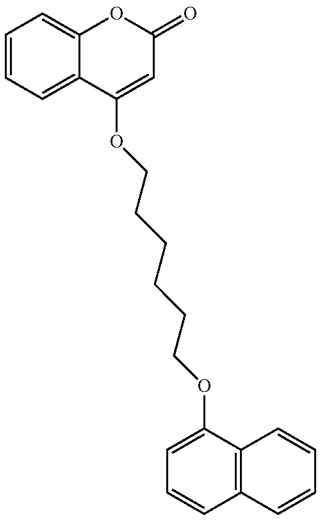

-continued

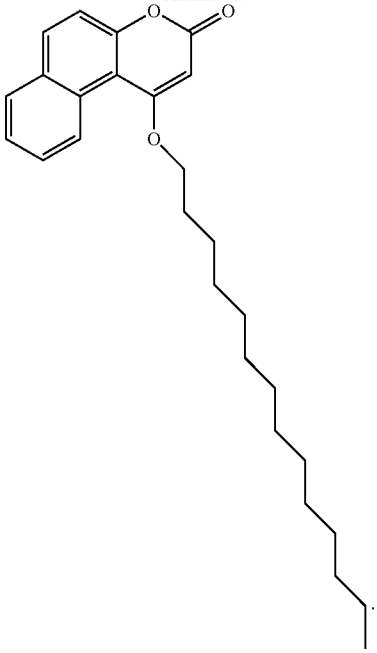

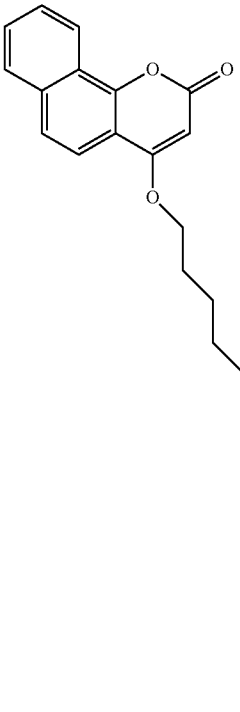

and

Embodiment 26 provides the base oil or lubricant additive of any one of Embodiments 1-25, wherein the base oil or lubricant additive is ocyl coumalate.

Embodiment 27 provides the base oil or lubricant additive of any one of Embodiments 1-26, wherein the base oil or lubricant additive is tetradecyl coumalate.

Embodiment 28 provides the base oil or lubricant additive of any one of Embodiments 1-27, wherein the base oil or lubricant additive is docosyl coumalate.

Embodiment 29 provides the base oil or lubricant additive of any one of Embodiments 1-28, wherein the base oil or lubricant additive is 4-tetradecyloxy-6-methyl-2-pyrone.

Embodiment 30 provides the base oil or lubricant additive of any one of Embodiments 1-29, wherein the base oil or lubricant additive is 4-tetradecyloxy coumarin.

Embodiment 31 provides the base oil or lubricant additive of any one of Embodiments 1-30, wherein the base oil or lubricant additive exhibits anti-wear properties, friction-reducing properties, or a combination thereof.

Embodiment 32 provides the base oil or lubricant additive of any one of Embodiments 1-31, wherein the base oil or lubricant additive exhibits anti-wear properties.

Embodiment 33 provides a lubricant composition comprising: the base oil or lubricant additive of any one of Embodiments 1-32.

Embodiment 34 provides the lubricant composition of Embodiment 33, wherein the lubricant composition comprises two or more base oils or lubricants of any one of Embodiments 1-32 that have different structures.

Embodiment 35 provides the lubricant composition of any one of Embodiments 33-34, wherein the base oil or lubricant additive is 0.001 wt % to 100 wt % of the lubricant composition.

Embodiment 36 provides the lubricant composition of any one of Embodiments 33-35, wherein the base oil or lubricant additive is 0.5 wt % to 100 wt % of the lubricant composition.

Embodiment 37 provides the lubricant composition of any one of Embodiments 33-36, wherein the base oil or lubricant additive is a lubricant additive, wherein the lubricant composition further comprises a base lubricant composition oil.

Embodiment 38 provides the lubricant composition of Embodiment 37, wherein the lubricant additive is 0.001 wt % to 50 wt % of the lubricant composition.

Embodiment 39 provides the lubricant composition of any one of Embodiments 37-38, wherein the lubricant additive is 0.1 wt % to 20 wt % of the lubricant composition.

Embodiment 40 provides the lubricant composition of any one of Embodiments 37-39, wherein the base oil is 50 wt % to 99.999 wt % of the lubricant composition.

Embodiment 41 provides the lubricant composition of any one of Embodiments 37-40, wherein the base lubricant composition oil comprises a mineral oil, a synthetic oil, or a combination thereof.

Embodiment 42 provides the lubricant composition of Embodiment 41, wherein the mineral oil is an API Group I mineral oil, an API Group II mineral oil, an API Group III mineral oil, an API Group IV mineral oil, an API Group V mineral oil, an API paraffinic mineral oil, an API naphthenic mineral oil, an aromatic mineral oil, or a combination thereof.

Embodiment 43 provides the lubricant composition of any one of Embodiments 41-42, wherein the mineral oil is an API Group III mineral oil.

Embodiment 44 provides the lubricant composition of any one of Embodiments 41-43, wherein the synthetic oil is a polyalpha-olefin, a synthetic ester, a polyalkylene glycol, a phosphate ester, an alkylated naphthalene, a silicate ester, an ionic fluid, a multiply alkylated cyclopentane, or a combination thereof.

Embodiment 45 provides the lubricant composition of any one of Embodiments 37-44, wherein the base lubricant composition oil comprises an isoparaffinic API Group III base oil.

Embodiment 46 provides the lubricant composition of any one of Embodiments 33-45, further comprising one or more oil additives.

Embodiment 47 provides the lubricant composition of any one of Embodiments 33-46, further comprising one or more oil additives comprising a pour point depressant, an anti-foaming agent, a viscosity index improver, an antioxidant, a detergent, a corrosion inhibitor, an anti-wear additive, a extreme pressure additive, a friction modifier, or a combination thereof.

Embodiment 48 provides a method of forming the lubricant composition of any one of Embodiments 33-47, the method comprises:

combining the base oil or lubricant additive with one or more other components to form the lubricant composition of any one of Embodiments 33-47.

Embodiment 49 provides a method of lubricating comprising:

applying the base oil or lubricant additive of any one of Embodiments 1-32, or the lubricant composition of any one of Embodiments 33-47, to an apparatus to lubricate the apparatus.

Embodiment 50 provides the method of Embodiment 49, wherein the method comprises applying the base oil or lubricant additive of any one of Embodiments 1-32, or the lubricant composition of any one of Embodiments 33-47, to a location in the apparatus that experiences surface-on-surface friction.

Embodiment 51 provides the method of Embodiment 49, wherein the method comprises applying the base oil or lubricant additive of any one of Embodiments 1-32, or the lubricant composition of any one of Embodiments 33-47, to a location in the apparatus that experiences metal-on-metal friction, metal-on-polymer friction, polymer-on-polymer friction, or a combination thereof.

Embodiment 52 provides the base oil, lubricant additive, lubricant composition, or method of any one or any combination of Embodiments 1-51 optionally configured such that all elements or options recited are available to use or select from.

What is claimed is:

1. A base oil or lubricant additive having the structure:

I

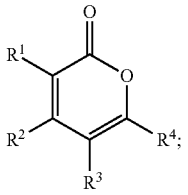

wherein $R^1$, $R^2$, $R^3$, and $R^4$ are independently chosen from —H, —($C_1$-$C_5$)hydrocarbyl and —$R^b$, the base oil or lubricant additive comprises at least one $R^b$, at each occurrence, $R^b$ is independently chosen from —C(O)—O—$R^c$, —O—$R^c$, —S—$R^c$, and —NH—$R^c$, and at each occurrence, $R^c$ is independently ($C_6$-$C_{30}$)hydrocarbyl that is unsubstituted or substituted with —O—($C_{6-20}$)aryl, wherein the ($C_6$-$C_{30}$)hydrocarbyl is interrupted by 0, 1, 2, 3, 4, or 5 groups independently chosen from —O— and —S—.

2. The base oil or lubricant additive of claim 1, wherein the base oil or lubricant comprises one and not more than one —$R^b$.

3. The base oil or lubricant additive of claim 1, wherein $R^1$, $R^2$, $R^3$, and $R^4$ are independently chosen from —H, methyl, and $R^b$.

4. The base oil or lubricant additive of claim 1, wherein each occurrence, $R^b$ is independently chosen from —C(O)—O—$R^c$.

5. The base oil or lubricant additive of claim 1, wherein at each occurrence, $R^c$ is independently ($C_{13}$-$C_{15}$)alkyl.

6. The base oil or lubricant additive of claim 1, wherein at each occurrence, $R^c$ is independently —$((CH_2—CH_2)—O)_n$—$CH_3$, wherein n is 1 to 10; —($C_6$-$C_{30}$)alkyl-O-phenyl; or —($C_6$-$C_{30}$)alkyl-O-naphthyl.

7. The base oil or lubricant additive of claim 1, wherein the base oil or lubricant additive is a lubricant additive.

8. The base oil or lubricant additive of claim 1, wherein $R^1$, $R^2$, $R^3$, and $R^4$ are independently chosen from —H and —$R^b$, the base oil or lubricant additive comprises one $R^b$ and not more than one $R^b$, and $R^b$ is —C(O)—O—($C_8$)alkyl, —C(O)—O—($C_{14}$)alkyl, —C(O)—O—($C_{22}$)alkyl, —C(O)—O—($C_{10}$)alkyl, or —C(O)—O—($C_{15}$)alkyl.

9. The base oil or lubricant additive of claim 1, wherein the base oil or lubricant additive has one of the following structures:

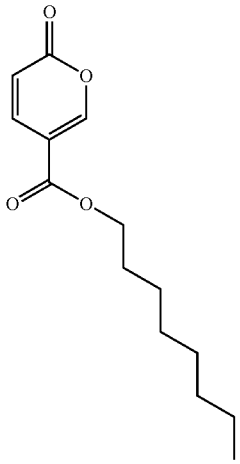
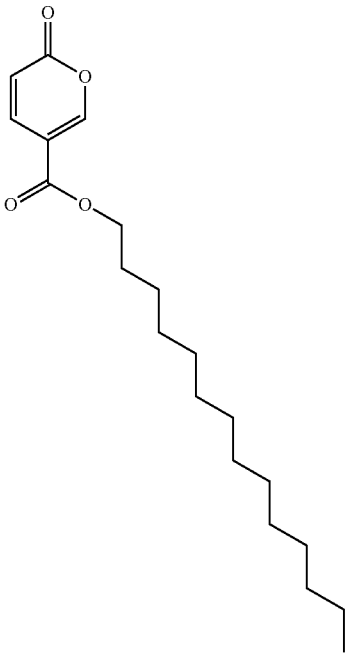
-continued
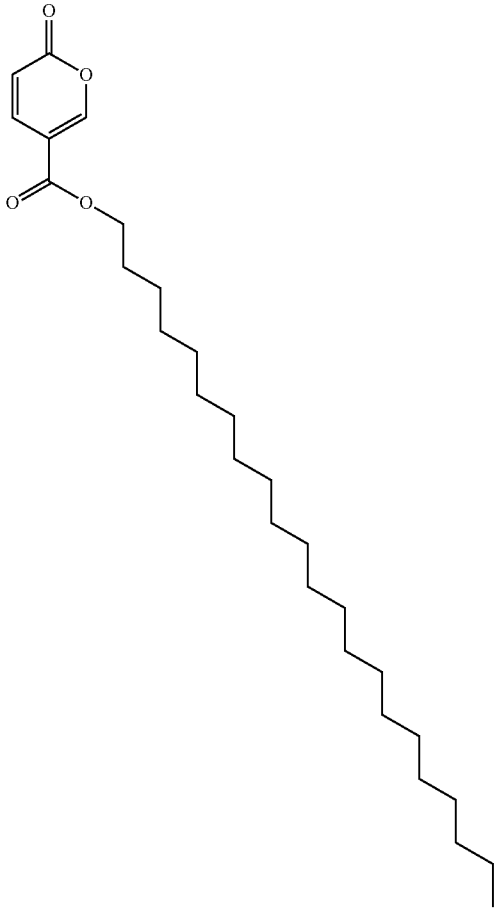
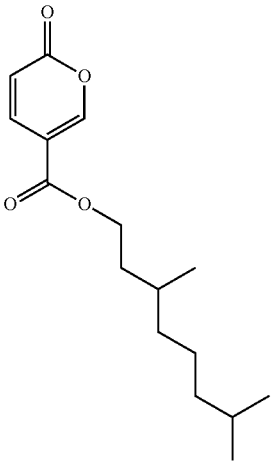

-continued

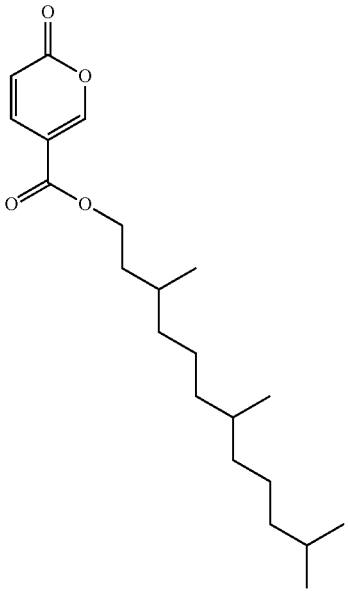

-continued

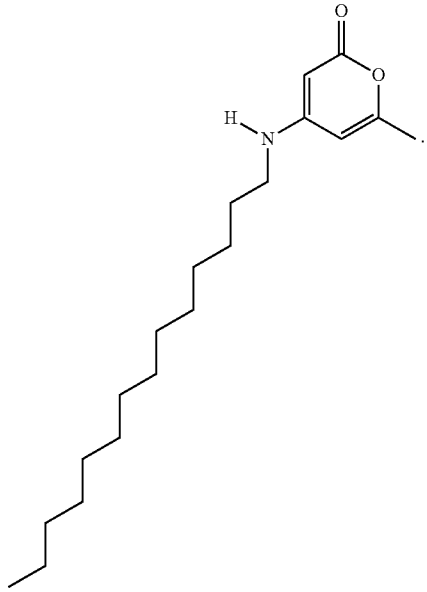

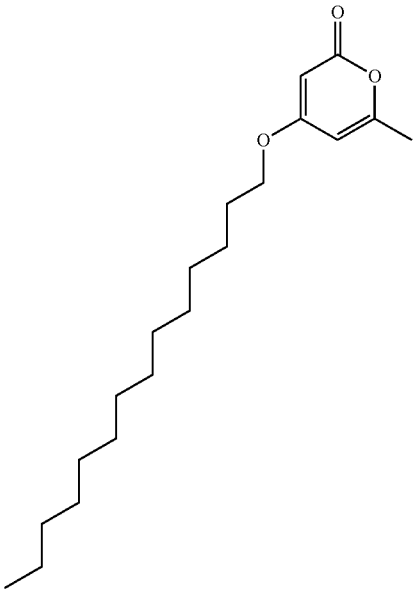

and

10. The base oil or lubricant additive of claim 1, wherein the base oil or lubricant additive is ocyl coumalate, tetradecyl coumalate, docosyl coumalate, or 4-tetradecyloxy-6-methyl-2-pyrone.

11. The base oil or lubricant additive of claim 1, wherein the base oil or lubricant additive is 4-tetradecyloxy-6-methyl-2-pyrone.

12. The base oil or lubricant additive of claim 1, wherein the base oil or lubricant additive is tetradecyl coumalate.

13. The base oil or lubricant additive of claim 1, wherein the base oil or lubricant additive exhibits anti-wear properties, friction-reducing properties, or a combination thereof.

14. A lubricant composition comprising:

the base oil or lubricant additive of claim 1.

15. The lubricant composition of claim 14, wherein the base oil or lubricant additive is a lubricant additive, wherein the lubricant composition further comprises a base lubricant composition oil.

16. The lubricant composition of claim 15, wherein the lubricant additive is 0.1 wt % to 20 wt % of the lubricant composition.

17. The lubricant composition of claim 15, wherein the base lubricant composition oil comprises a mineral oil, a synthetic oil, or a combination thereof.

18. The lubricant composition of claim 17, wherein the mineral oil is an API Group III mineral oil.

19. A method of forming the lubricant composition of claim 15, the method comprises:

combining the base oil or lubricant additive with one or more other components to form the lubricant composition of claim 15.

20. A method of lubricating comprising:

applying a base oil or lubricant additive, or a lubricant composition comprising the same, to an apparatus to lubricate the apparatus, wherein the base oil or lubricant additive has the structure:

I

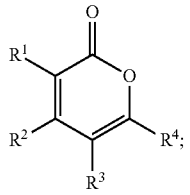

wherein $R^1$, $R^2$, $R^3$, and $R^4$ are independently chosen from —H, —($C_1$-$C_5$)hydrocarbyl and —$R^b$, the base oil or lubricant additive comprises at least one $R^b$, at each occurrence, $R^b$ is independently chosen from —C(O)—O—$R^c$, —O—$R^c$, —S—$R^c$, and —NH—$R^c$, and at each occurrence, $R^c$ is independently ($C_6$-$C_{30}$)hydrocarbyl that is unsubstituted or substituted with —O—($C_{6-20}$)aryl, wherein the ($C_6$-$C_{30}$)hydrocarbyl is interrupted by 0, 1, 2, 3, 4, or 5 groups independently chosen from —O— and —S—.

* * * * *